US008382645B2

(12) United States Patent
Mylrea et al.

(10) Patent No.: US 8,382,645 B2
(45) Date of Patent: Feb. 26, 2013

(54) METHOD AND APPARATUS FOR FITNESS EXERCISE

(75) Inventors: Mindy Mylrea, Santa Cruz, CA (US); Jeff Tuller, San Marcos, CA (US)

(73) Assignee: Savvier, LP, Carlsbad, CA (US)

( * ) Notice: Subject to any disclaimer, the term of this patent is extended or adjusted under 35 U.S.C. 154(b) by 1242 days.

(21) Appl. No.: 11/843,085

(22) Filed: Aug. 22, 2007

(65) Prior Publication Data

US 2007/0287605 A1 Dec. 13, 2007

Related U.S. Application Data

(62) Division of application No. 10/958,190, filed on Oct. 4, 2004.

(60) Provisional application No. 60/568,070, filed on May 3, 2004.

(51) Int. Cl.
*A63B 21/00* (2006.01)
*A63B 22/20* (2006.01)
*A63B 23/10* (2006.01)

(52) U.S. Cl. ..... 482/51; 482/79; 482/148; 482/66

(58) Field of Classification Search ..... 482/44, 482/51, 79, 80, 92, 131, 132, 140, 907; 601/27–32, 601/35, 104

See application file for complete search history.

(56) References Cited

U.S. PATENT DOCUMENTS

| | | | | |
|---|---|---|---|---|
| 2,069,384 | A * | 2/1937 | Ogden | 482/132 |
| 4,132,404 | A * | 1/1979 | Wilson | 482/132 |
| 4,568,297 | A | 2/1986 | Dunipace | |
| 4,892,305 | A * | 1/1990 | Lynch | 482/132 |
| 4,915,661 | A | 4/1990 | Getgey | |
| 5,026,054 | A | 6/1991 | Osher et al. | |
| 5,209,490 | A | 5/1993 | Dallavecchia | |
| 5,322,493 | A * | 6/1994 | Venner | 482/131 |
| 5,540,610 | A | 7/1996 | Sneddon | |
| 5,891,002 | A * | 4/1999 | Maki | 482/79 |
| 6,071,214 | A | 6/2000 | Osterman | |
| 6,241,570 | B1 | 6/2001 | Thorne, III | |
| 6,328,680 | B1 * | 12/2001 | Shifferaw | 482/132 |
| 6,604,742 | B2 | 8/2003 | El Sabbagh | |
| 6,695,666 | B2 | 2/2004 | Nikonorov | |
| 6,749,782 | B2 | 6/2004 | Chen | |
| 6,840,836 | B1 | 1/2005 | Siverson | |
| 6,887,119 | B2 | 5/2005 | Bloeme et al. | |
| 6,908,415 | B2 * | 6/2005 | Branson | 482/51 |
| 6,942,605 | B1 * | 9/2005 | Sukhovitsky | 482/132 |
| 6,984,195 | B1 | 1/2006 | Phillips | |
| 2004/0248713 | A1 * | 12/2004 | Campanaro et al. | 482/123 |

FOREIGN PATENT DOCUMENTS

WO WO 2004/062550 A1 * 7/2004

OTHER PUBLICATIONS

Sherman, Alexa Joy; "5-minute fitness"; Shape Magazine; Nov. 2003; pp. 166-171.

* cited by examiner

*Primary Examiner* — Loan Thanh
*Assistant Examiner* — Sundhara Ganesan
(74) *Attorney, Agent, or Firm* — Patton Boggs LLP

(57) ABSTRACT

A method of exercising a human body, the method comprising: providing a sliding element having a body portion adapted for receiving a limb of the human body, and a sliding surface adapted to slide on a exercise floor; placing the sliding element on an exercise floor and placing the human body limb on the body portion; and performing an exercise routine including sliding the sliding element by moving the human body limb. The exercise routine includes routines performed with the human body in a standing position; routines performed with the human body in a prone position; routines performed with the human body in a supine position; and routines performed with the human body in a side-lying position. The invention also includes an exercise device for exercising a human body, the device comprising: a sliding disc having a body portion adapted for receiving a limb of the human body; and a sliding surface adapted to slide on an exercise floor.

7 Claims, 18 Drawing Sheets

METHOD AND APPARATUS FOR FITNESS EXERCISE

CROSS-REFERENCE TO RELATED APPLICATIONS

This application is a divisional application of U.S. patent application Ser. No. 10/958,190 filed Oct. 4, 2004, which application claims priority from U.S. Provisional Application Ser. No. 60/568,070 filed May 3, 2004. The entirety of this provisional application is incorporated by reference to the same extent as though fully disclosed herein.

BACKGROUND OF THE INVENTION

1. Field of the Invention

The invention relates to fitness exercises, and more particularly to a disc that can be slid over a floor with a foot or other body portion and sliding type fitness routines to be performed using the disc.

2. Statement of the Problem

A wide variety of fitness exercises are known. Aerobic type fitness exercises in particular are presently highly popular. These exercises are often enhanced by weights, steps, medicine balls, and other elements which increase the value of the exercise; that is permit greater strength and endurance to be gained in less time. Most of these exercise enhancement elements are bulky and not easily portable and are thus usually used only in gyms, exercise rooms and other permanent exercise areas. In addition, most exercise enhancement elements increase the resistance to movement and/or an increased muscular force required to perform an exercise, without a commensurate increase in muscle and ligament flexibility. Thus, most exercise routines include stretching and warm-up routines that increase the total required exercise time for a given result. Thus, an exercise enhancement element that was relatively inexpensive, portable, and/or more readily adaptable to a variety of environments would be highly desirable in itself. If in addition, it lent itself to a corresponding exercise routine using the enhancement element, which routine provided enhanced muscular force and resistance to movement and at the same time increased flexibility, would be highly desirable because it could reduce the total required exercise time to produce a given result.

SOLUTION

The present invention advances the art and overcomes the aforementioned problems by providing a sliding element that permits exercise routines that could not previously be performed without complex exercise equipment and facilities. Preferably, the sliding element is a disc or other element that preferably slides substantially uniformly in any direction. The invention also provides corresponding exercise routines in which the user places a body part, such as a foot or hand, on the sliding element, weights the body part, and slides the body part and sliding element on a floor or other exercise support structure.

The invention provides a method of exercising a human body, the method comprising: providing a sliding element having a body portion adapted for receiving a limb of the human body, and a sliding surface adapted to slide on a exercise floor; placing the sliding element on an exercise floor and placing the human body limb on the body portion; and performing an exercise program including sliding the sliding element by moving the human body limb. Preferably, the exercise program comprises two or more routines selected from the group consisting of: routines performed with the human body in a standing position; routines performed with the human body in a prone position; routines performed with the human body in a supine position; and routines performed with the human body in a side-lying position. More preferably, the exercise program comprises three of more routines selected from the group.

The invention also provides an exercise device for exercising a human body, the device comprising: a sliding element having a body portion adapted for receiving a limb of the human body; and a sliding surface adapted to slide on an exercise floor. Preferably, the body portion includes a circular plate and the sliding surface is on one side of the plate. Preferably, the body portion includes upper surface on the opposite side of the plate from the sliding surface and a circumferal member extending away from the plate in a direction at an angle to the upper surface. Preferably, the device is made of a polymer, most preferably nylon. Preferably, the sliding surface includes a friction adjustment/protective layer.

The invention for the first time provides an exercise routine that enhances the results of exercise by the use of a simple, portable device that can be used to exercise nearly every muscle in the body and in both strength exercises and stretching exercises. Numerous other features, objects and advantages of the invention will become apparent from the following description when read in conjunction with the accompanying drawings.

DETAILED DESCRIPTION OF THE PREFERRED EMBODIMENT

I. Introduction

Figure 1A:
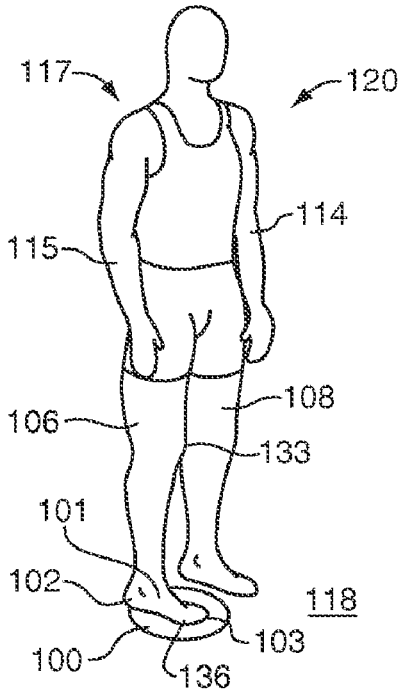
FIGS. 1A and 1B illustrate a forward lunge exercise according to the invention.

The invention comprises one or more exercises performed with the assistance of a sliding element that is designed to slide on an exercise floor. In this disclose, the term "sliding element" means an element that is intentionally designed to slide on an exercise floor, not an element, such as a step used in a step exercise program or a mat that may accidentally slide but is not designed for that purpose. It also does not include an exercise machine that is designed to sit stably on an exercise floor without moving as a whole and includes a member that slides on another member. It also does not include a ski, because the ski is not designed to slide on an exercise floor. Nor does it include a skate, or a skateboard, since these devises are designed to roll, not slide. Further, it does not include a shoe, since shoes are not specifically designed for sliding on an exercise floor, say as distinguished from a dance floor. Preferably the sliding element is an integral element in that all parts are connected together so that all move as one. Preferably the sliding element is adapted so that the limb can be quickly removed from the element without unfastening a fastener and without holding the element and pulling it off the limb. In this disclosure placing a limb on the sliding element means that the limb is simply set down on the element without fastening the element to the limb and without placing any portion of the limb inside the sliding element so that some force is required to remove it.

The invention was first described in article by Alexa Joy Sherman and photographs by James Allen in Shape Magazine, November 2003, pp. 166-171, which article was based on a workout designed by the inventor, Mindy Mylrea. This article is hereby incorporated by reference to the same extent as though fully disclosed herein. This article shows an embodiment of the exercises as done using a paper plate as the sliding element or disc. The invention contemplates that the exercises may be performed using a paper plate, a piece of cardboard, or other sliding element. In the preferred embodiment, the exercises are done with a sliding element or disc according to the invention which is described in detail in Section 3, below.

Like other exercise enhancement equipment, such as weights, stairs, rowing and pedal machines, etc., the sliding disk 100 according to the invention increases the muscular force required to perform an exercise. This is primarily due to the fact that the reduction of friction under the limb on the sliding exercise device requires the complementary muscles associated with other parts of the body involved in the exercise to work harder to perform the exercise. For example, referring to FIGS. 1A and 1B, if a lunge is performed without the sliding element 100, the friction between the right foot 101 and the floor 102 permits the muscles of the right leg 106 to assist in pulling the body upright after the lunge. However, when the lunge is performed with the sliding element 100, the reduced friction between the right foot 101 and floor 102 does not allow the muscles of the right leg to assist as much. Thus the muscles of the left leg 108 must exert more effort to pull the body upright. This increases both the magnitude and speed of strength gain from the exercise. In addition, the lessened friction under one leg requires the user to exercise more the muscles used in balancing the body during the exercise, which enhances both the strength of these muscles and the ability to balance which are important aspects of most athletic sports. Also, the lack of friction under one leg extends the range of motion between the two legs 106 and 108 allowing the leg ligaments and muscles to be more easily and more widely stretched. In this way, the sliding exercises and sliding element 100 according to the invention enhance muscle and ligament flexibility at the same time as the exercise is being performed. It is well-known in the exercise art that stretching exercises should be performed before and after muscle enhancement exercises to prevent tightening and reduction of flexibility in muscles and ligaments. Since the sliding exercises according to the invention include stretching elements within the exercises, the total length of a workout is reduced. Thus, the sliding exercises and sliding exercise elements according to the invention not only enhance the amount of strength, balance and flexibility gain during the exercises, but also make the exercising more efficient.

The sliding discs according to the invention which will be described in detail below are designed to smoothly glide across a floor surface with either on foot or both feet placed on the disc, or alternately, one hand or both hands. Exercises can be performed in many positions, including standing, prone, supine and seated. In the basic exercise position, as shown in FIG. 1A, the arms 114, 115 are generally relaxed at the sides, the knee 133 of the leg on the disc 100 is slightly bent, the ball 136 of the foot 101 is approximately on the center of the disc 100, and the heel 102 is extended off the disc. This way, at any point, the user can easily halt the movement by simply relaxing the foot so the heel touches the ground 118.

In the seated and supine positions, the basic foot position generally will not be used. In these cases, in the preferred position, the heel is place in the center of the disc, with the ball of the ball of the foot extended off the disc and the toes flexed as shown in FIG. 15B.

In some exercises, the hands are placed on the discs instead of the feet. Most hand sizes will fit easily inside the disc frame. Depending on the exercise, the hand position will vary. The user should adapt to the individual needs of the effort, such as shown in FIGS. 13A, 19A, 21B, and 28B, for example.

Generally, feet or hands should be realigned as the movement progress as discs will shift during exercises.

II. Description of the Exercises

Exemplary exercises that embody the invention are shown in FIGS. 1A through 36B and 46-48. It should be understood that the invention is not limited to these exercises. Rather the exercises have been selected to demonstrate to those skilled in the art the variety of exercises contemplated by the invention, so that they can better understand the invention and be able to create additional exercises. It should also be understood that the drawings are not exact replications of an exercise, but are only meant to illustrate the approximate body positions so that the exercise can be better understood.

Figure 1B:
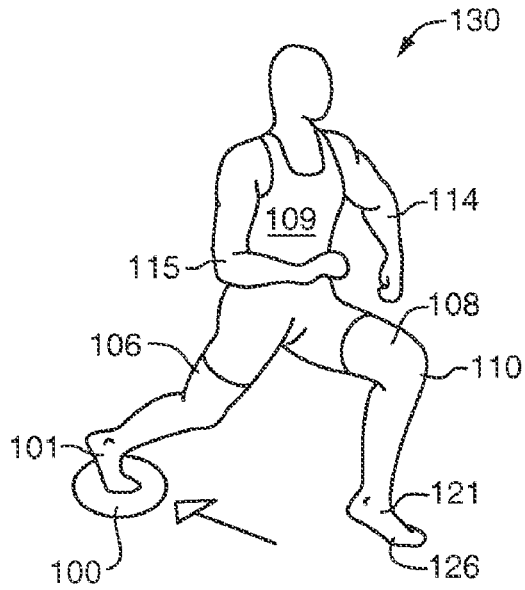

FIGS. 1A and 1B illustrate a forward lunge exercise according to the invention. This exercise is shown starting from a standing rest position 120. In the In this exercise, a exercise element 100 is placed under one foot 101, the exerciser begins in the basic exercise position 120 discussed above, and the foot 101 is pushed backward as the opposite knee 110 is bent with sufficient weight on the ball 126 of the opposite foot 121 to balance, and the trunk 109 of body 117 is lowered to a forward lunge position 130. The body is then returned to an upright position, particularly using the muscles of the bent leg 108. The arms 114 and 115 participate with other muscles to balance the body during the exercise.

Figure 2A:
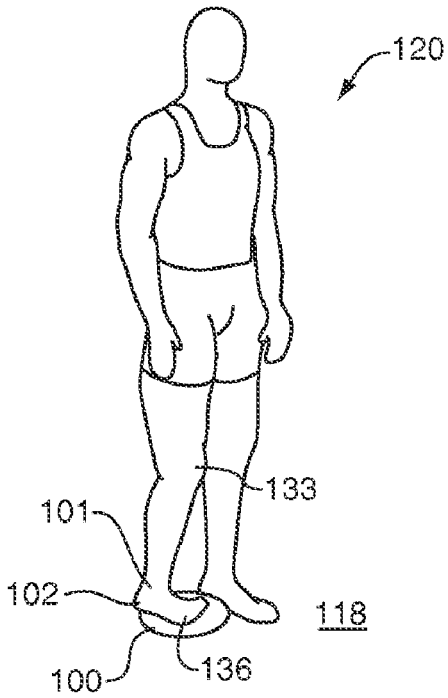
FIGS. 2A and 2B illustrate a sideways lunge exercise according to the invention.
Figure 2B:
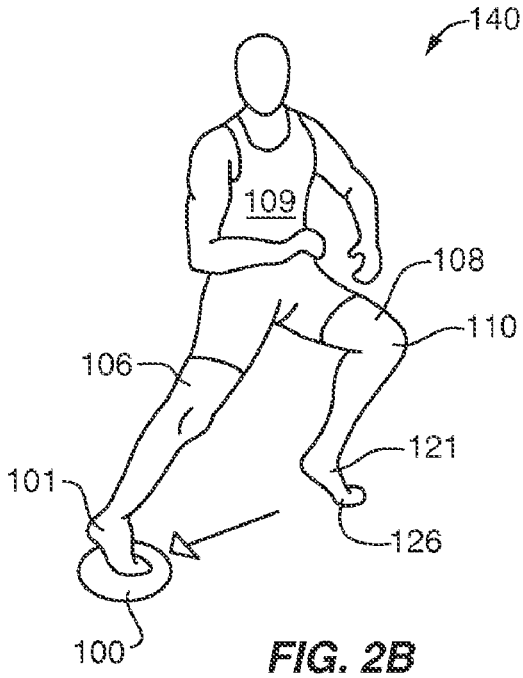

FIGS. 2A and 2B illustrate a sideways lunge exercise according to the invention. The sideways lunge begins from the basic exercise position 120 shown in FIG. 2A. The foot 101 is pushed sideways as the opposite knee 110 is bent with sufficient weight on the ball 126 of the opposite foot 121 to balance, and the body 109 is lowered to a sideways lunge position 140. The body is then returned to an upright position, particularly using the muscles of the bent leg 108. The arms 114 and 115 participate with other muscles to balance the body during the exercise.

Figure 3A:
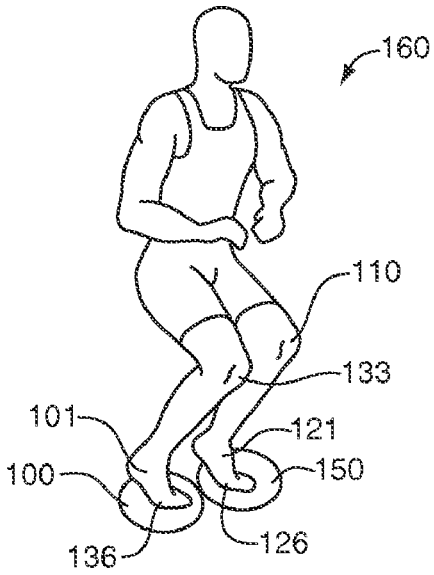
FIGS. 3A and 3B illustrate a squat lunge exercise according to the invention.
Figure 3B:
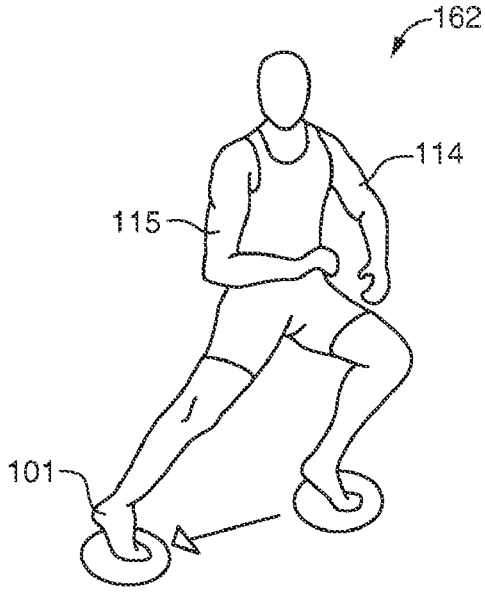

FIGS. 3A and 3B illustrate a squat sideways lunge exercise according to the invention. The exercise starts from a squat position 160 shown in FIG. 3A in which feet 101 and 121 are on placed on discs 100 and 150, respectively, with the weight on the balls 136 and 126 of the feet and knees 133 and 110 bent. One foot 101 is thrust sideways to the sideways squat lunge position 162, with the arms balancing the body. The body is then returned to the squat position 160.

Figure 4A:
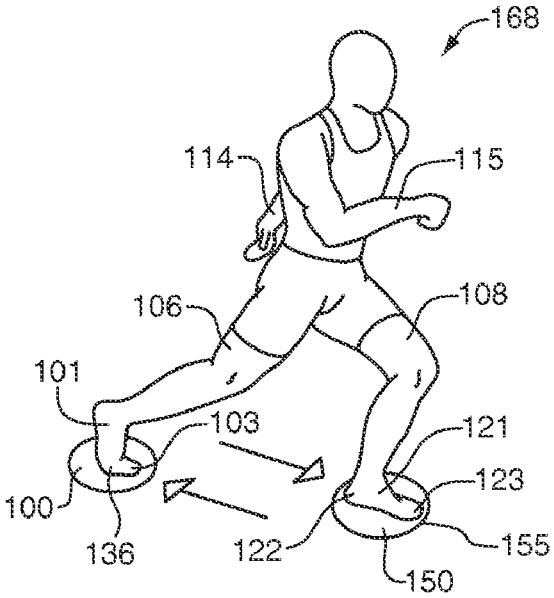
FIGS. 4A and 4B illustrate a power ski exercise according to the invention.
Figure 4B:
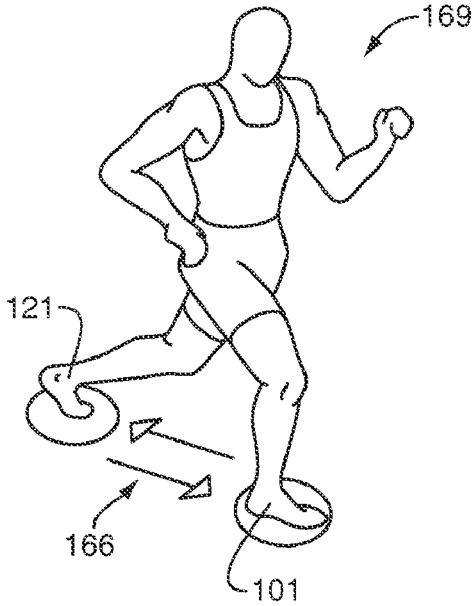

FIGS. 4A and 4B illustrate a power ski exercise according to the invention. This exercise begins in the basic exercise position with two discs, which is similar to 160, without the squat; that is, with the knees 133 and 110 bent only slightly. One foot 101 is thrust backwards, while the other foot 121 is thrust forwards. The weight is on the ball 136 and toes 103 of the foot 101 that is thrust backwards, while the foot 121 that is thrust forwards slides a little forward on the disk until it encounters the forward edge 155 of disc 150 and there is a natural shift of the weight to the full foot as the heel 122 is lowered. The arms 114 and 115 move in opposite directions to the corresponding feet 121 and 101, in a natural cross-country skiing type motion 168. The body is then returned to the dual disc upright position and the feet 101 and 121 are thrust in the opposite directions as shown by the arrows 166, with the various parts adjusting as described above, except that the description is for the opposite body parts as indicated in position 169.

Figure 5A:
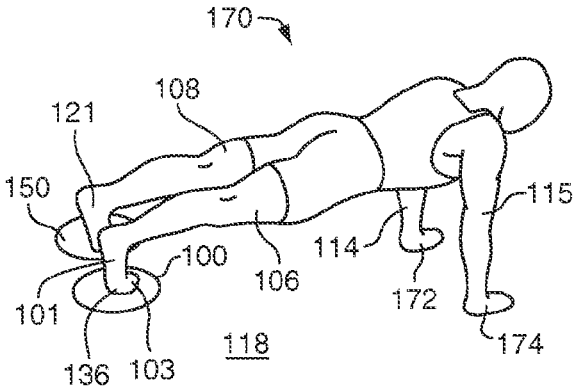
FIGS. 5A and 5B illustrate a push-up/pull-in exercise according to the invention.
Figure 5B:
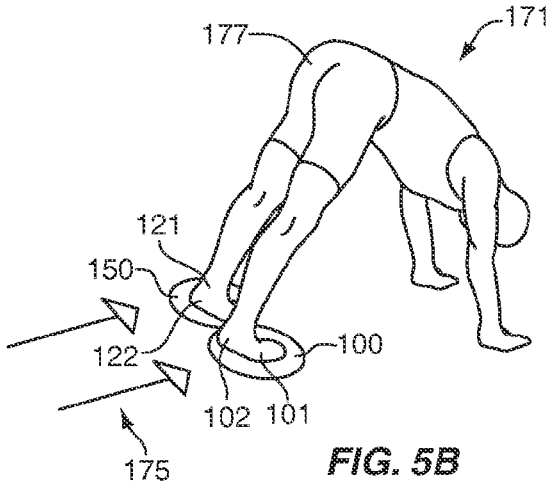

FIGS. 5A and 5B illustrate a push-up/pull-in exercise according to the invention. The exercise is begun from the basic push-up position 170 shown in FIG. 5A. In the position 170 the arms 114 and 115 are extended with palms 172 and 174 on the floor 118. The legs 106 and 108 are extended and each foot 121 and 101 is on a separate disc 150 and 100, respectively, with the ball 136 of the foot and toes 103 in the center of the disk and supporting the weight. The feet 121 and 101 are then pulled in the direction of the arrows 175 while raising the buttocks 177 to reach position 171. The feet 121 and 101 slide a little forward on their respective discs 150 and 101, and the heels 122 and 102 are lowered naturally. The feet are then pushed back out in the direction opposite to the arrows 175 to return to the position 170.

Figure 6A:
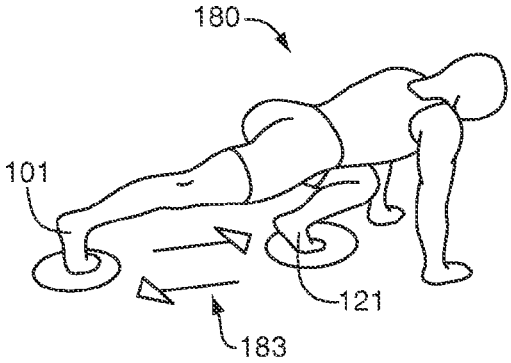
FIGS. 6A and 6B illustrate a road runner exercise according to the invention.
Figure 6B:
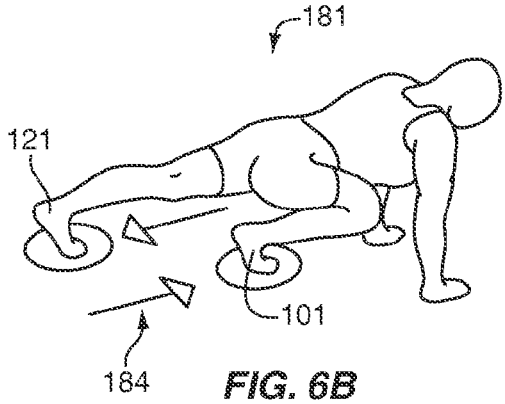

FIGS. 6A and 6B illustrate a road runner exercise according to the invention. This exercise can start in the basic push-up position 170, either of the positions 180 and 181 shown in FIGS. 6A and 6B, respectively, or in an intermediate position to the positions 180 and 181, such as the position 188 shown in FIG. 7A. In this exercise, the feet 101 and 121 are alternately thrust in opposite directions 183 and 184, with the positions of feet 101 and 121 on their respective discs 100 and 150 changing only a little in a natural manner to maintain balance.

Figure 7A:
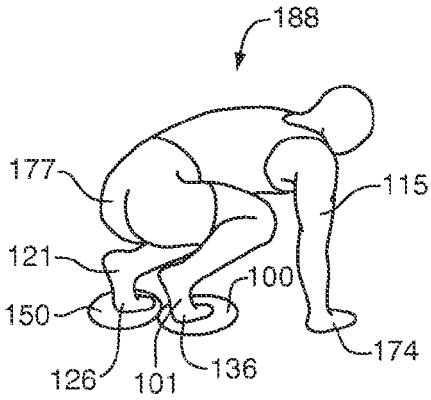
FIGS. 7A and 7B illustrate a hamstring extension exercise according to the invention.
Figure 7B:
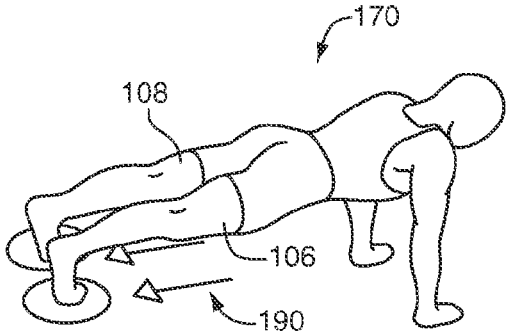

FIGS. 7A and 7B illustrate a hamstring extension exercise according to the invention. This exercise begins in a basic two-disc crouch position 188 with the arms 114 and 115 extended and palms 172 and 174 on the floor, but with the feet 101 and 121 drawn up under the buttocks 177. The balls 136 and 126 of the feet 121 and 101 are in the center of their respective discs 150 and 100. The legs 106 and 108 are then extended backwards in the direction 190 until the basic push-up position 170 is reached. The feet 121 and 101 are then pulled forward to reach the position 188 again.

Figure 8A:
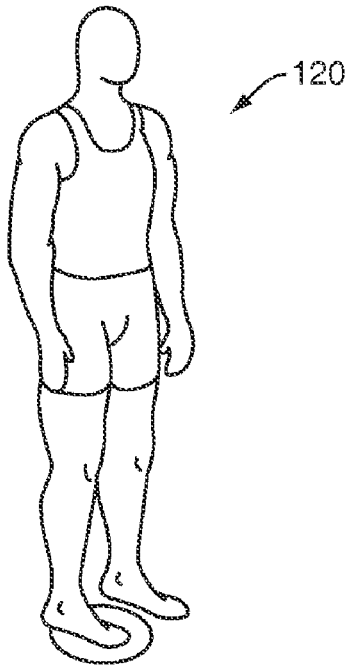
FIGS. 8A and 8B illustrate a power skate exercise according to the invention.
Figure 8B:
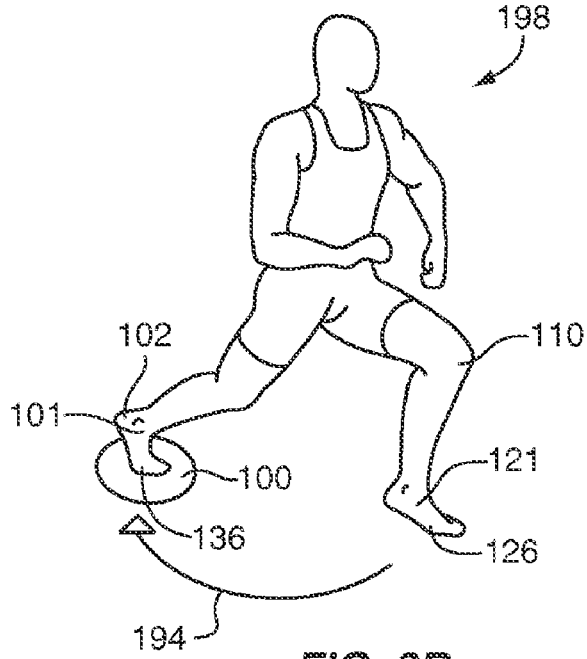

FIGS. 8A and 8B illustrate a one-disc power skate exercise according to the invention. FIG. 8A shows the basic one-disc exercise position 120 (FIG. 1A). In this exercise, the exerciser thrusts one foot 101 to the side and back in the direction of the arrow 194 in a skating motion while bending the opposite knee 110. The foot 101 ends up with the weight on the ball 136 and toes 102 of the foot 101 and the ball 136 and toes 102 in the center of the disc 100, while the foot 121 is essentially flat, though with the weight mostly on the ball 126 of the foot as shown in position 198. The exercise is completed by returning to the basic exercise position 120.

Figure 9A:
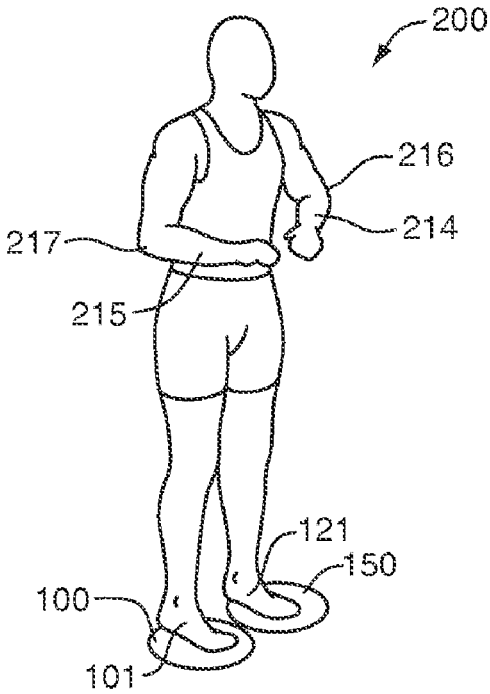
FIGS. 9A and 9B illustrate a plie exercise according to the invention.
Figure 9B:
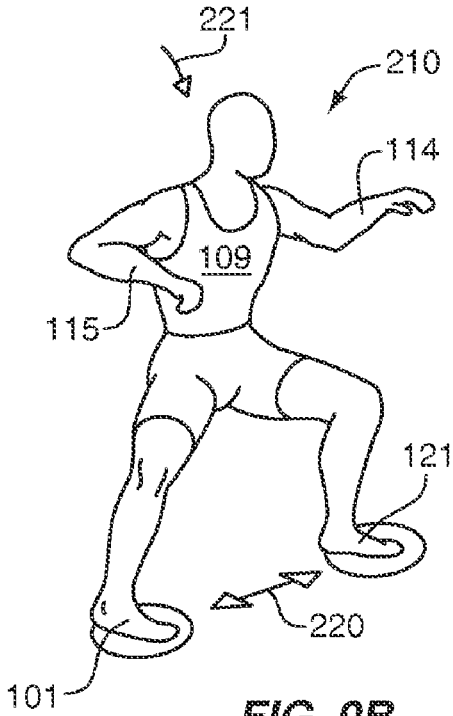

FIGS. 9A and 9B illustrate a plie exercise according to the invention. The exerciser starts in the basic two-disc position 200, which is the same as the basic exercise position 120, except with each foot 102 and 121 on a separate disc 100 and 150, respectively, and the forearms 214 and 215 raised and elbows 216 and 217 bent. The feet 101 and 121 are then spread apart as shown by the arrow 220 while the trunk 109 sinks as shown by the arrow 221. The arms 114 and 115 extend sufficiently to maintain balance. The exercise is completed by drawing the feet 101 and 121 back together and returning to the position 200.

Figure 10A:
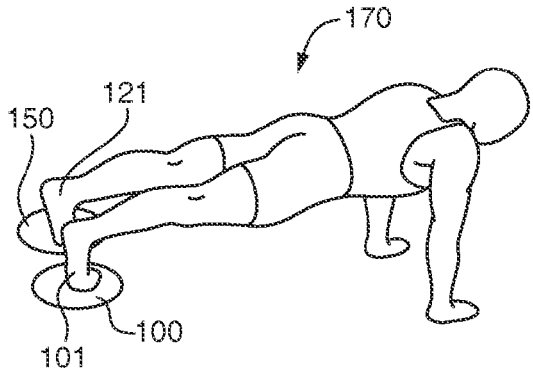
FIGS. 10A and 10B illustrate a prone hamstring stretch exercise according to the invention.
Figure 10B:
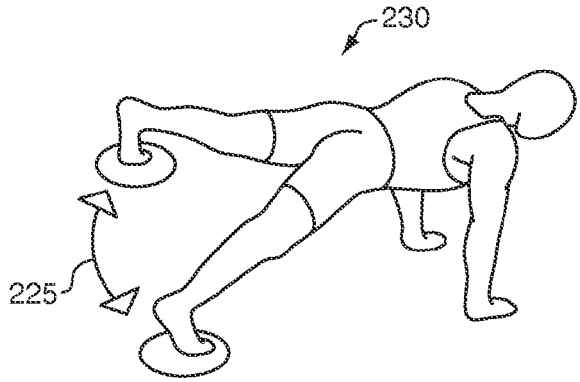

FIGS. 10A and 10B illustrate a prone hamstring stretch exercise according to the invention. The exercise starts in the basic push-up position, with a disk 100 and 150 under each foot 101 and 121. The feet 101 and 121 are then spread apart as shown by the arrow 225 into the position 230. The exercise is completed by bringing the feet back to the position 170.

Figure 11A:
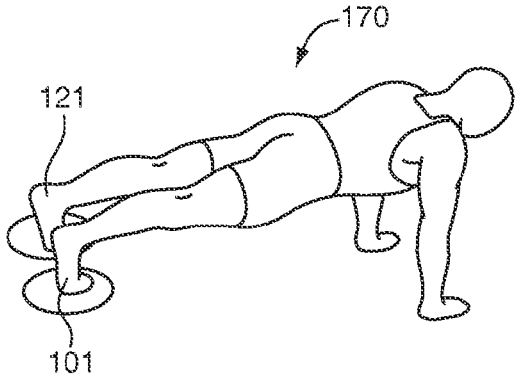
FIGS. 11A and 11B illustrate a prone cross-under exercise according to the invention.
Figure 11B:
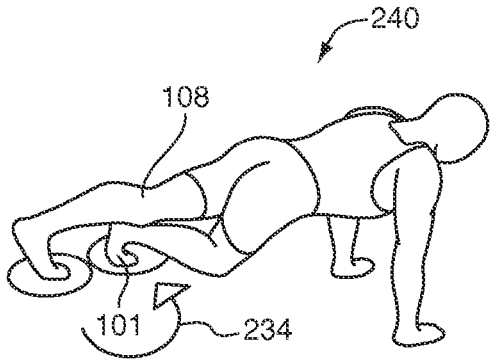

FIGS. 11A and 11B illustrate a prone cross-under exercise according to the invention. Again this exercise starts in the basic push-up position 170. One foot 101 is then crossed under the opposite leg as shown by the arrow 234 to arrive at the position 240. The foot 101 is then returned to the position 170, and the other foot 121 may be crossed under and returned.

Figure 12A:
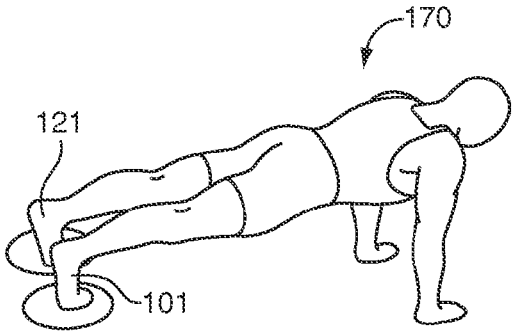
FIGS. 12A and 12B illustrate a prone hamstring stretch exercise according to the invention.
Figure 12B:
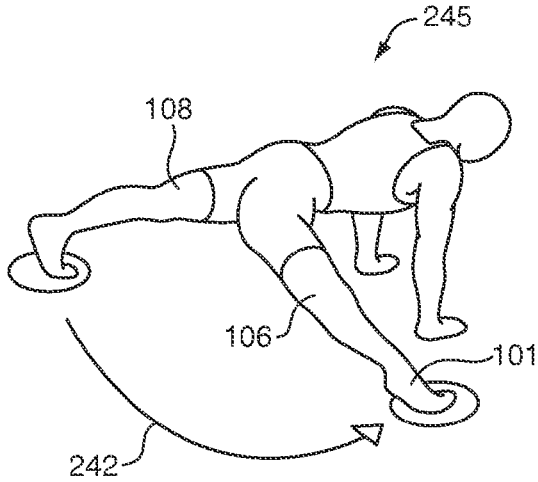

FIGS. 12A and 12B illustrate a prone hamstring stretch exercise according to the invention. Again this exercise starts in the basic push-up position 170. One foot is then moved outward along the path of the arrow 242. After a suitable stretch period, the foot 101 is moved back to the position 170. This also may be done with the opposite leg 108.

Figure 13A:
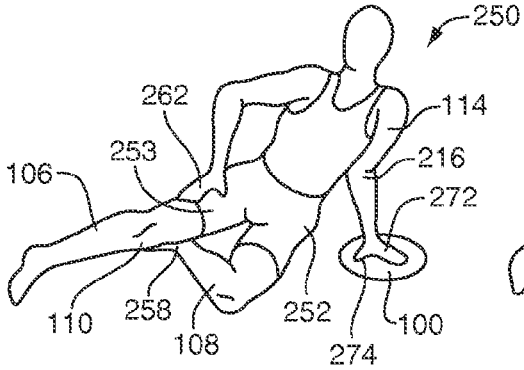
FIGS. 13A and 13B illustrate a sidelying arm stretch exercise according to the invention.
Figure 13B:
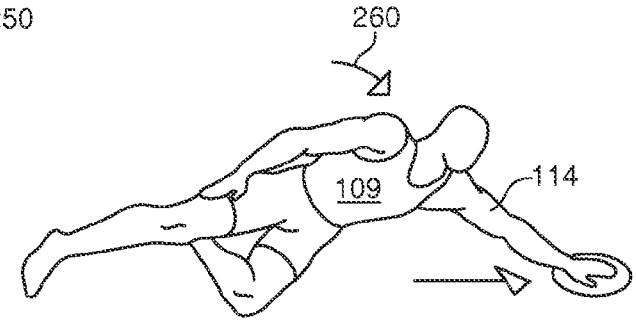

FIGS. 13A and 13B illustrate a sidelying arm stretch exercise according to the invention. This exercise begins in a sidelying position 250 with the body resting on one hip 252 and thigh leg 108 and one hand 262 placed on the opposite thigh 253. One ankle 258 is under the opposite leg 106 at just above the position of the knee 110. The leg 108 not folded under is extended. One hand 272 placed on a disk 100 with the palm down, and the corresponding elbow 216 bent. The thumb 274 may be spread for stability to complete the position 250. The body 109 is then lunged forward to position 260 and the arm 114 extended for a suitable stretch period, then returned to the position 250.

Figure 14A:
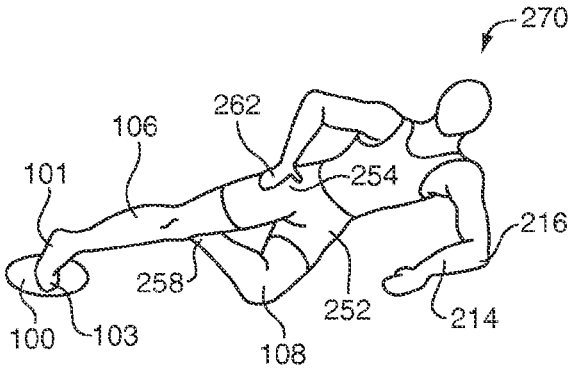
FIGS. 14A and 14B illustrate another sidelying leg stretch exercise according to the invention.
Figure 14B:
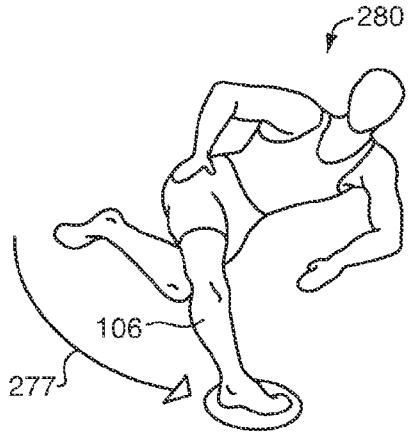

FIGS. 14A and 14B illustrate another sidelying leg stretch exercise according to the invention. This exercise starts in the sidelying position 270 with the body lying on the hip 252 and leg 108 and one ankle 258 crossed under leg 106 as before. The body rests on arm 214 and elbow 216, which is bent. The opposite hand 262 rests on hip 254. Leg 106 is extended with the toe 103 of foot 103 on disc 100. The extended leg 196 is moved in the direction of arrow 277 to the position 280. After a suitable stretch period, the leg and body are returned to the position 270.

Figure 15A:
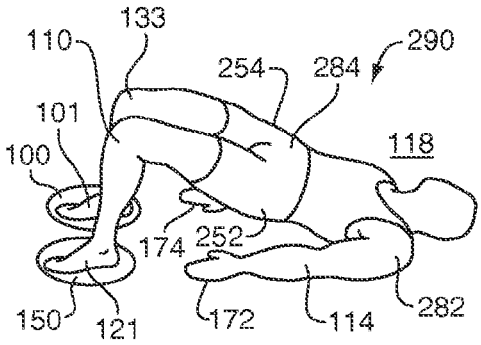
FIGS. 15A and 15B illustrate a supine hamstring extension exercise according to the invention.
Figure 15B:
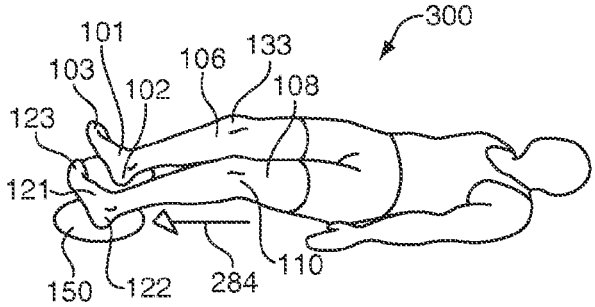

FIGS. 15A and 15B illustrate a supine hamstring extension exercise according to the invention. The exercise begins in a prone position 290 with the shoulders 282 and arms 114 and 115 on the floor 118 with palms 172 and 174 facing down. Disc 150 is underfoot 121 and disc 100 is underfoot 101, with the knees 133 and 110 bent and the feet placed flat across the center of the discs so the thighs and lower torso 284 are raised. The knees 133 and 110 are straightened and the feet 121 and 101 pushed out in the direction of arrow 184 with the toes 123 and 103 rising naturally and the heels 122 and 102 rotating to the center of the discs 150 and 100, respectively, as shown in the position 300. The feet 121 and 101 are then pulled in to return to the position 290.

Figure 16A:
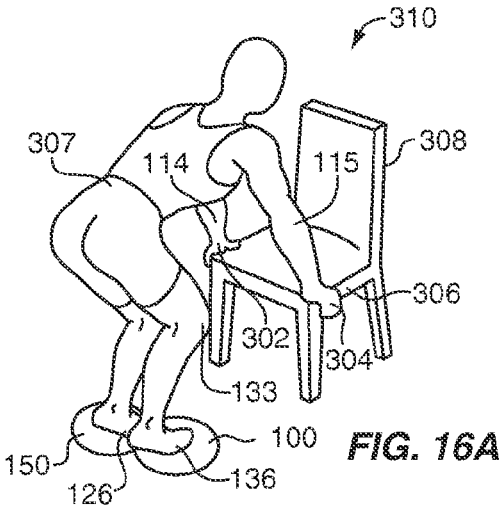
FIGS. 16A and 16B illustrate a push-up/pull-in using a support exercise according to the invention.
Figure 16B:
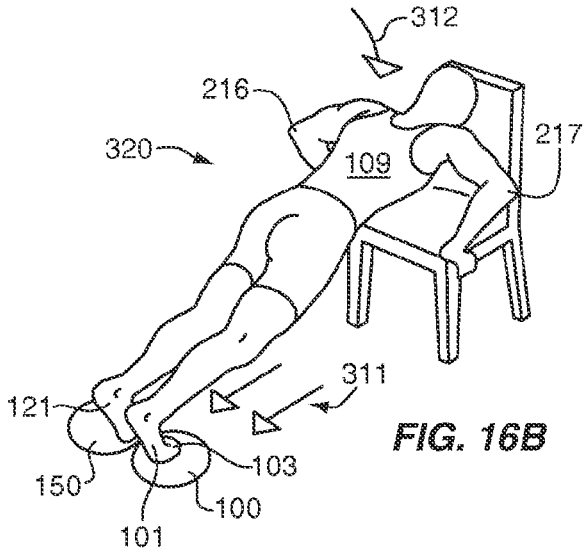

FIGS. 16A and 16B illustrate a push-up/pull-in using a support 308 exercise according to the invention. In this illustration the support 308 is a chair, though other suitable supports may be used. The exercise starts in the position 310 with the balls 126 and 136 of the feet in the center of the respective discs 150 and 100, the knees 110 and 133 bent, hands 302 and 304 grasping the sides 306 of the chair near the front of the chair, arms 114 and 115 straight and the body leaning forward at the waist 307. The elbows 216 and 217 are then bent to lower the body 109 in the direction of arrow 312 as in a push-up, and the feet 121 and 101 are then thrust out in the direction of the arrows 311 with the feet rotating in the discs 150 and 101 so the weight is transferred forward toward the toes 123 and 103. The elbows are then straightened and the feet pulled in to return to the position 310.

Figure 17A:
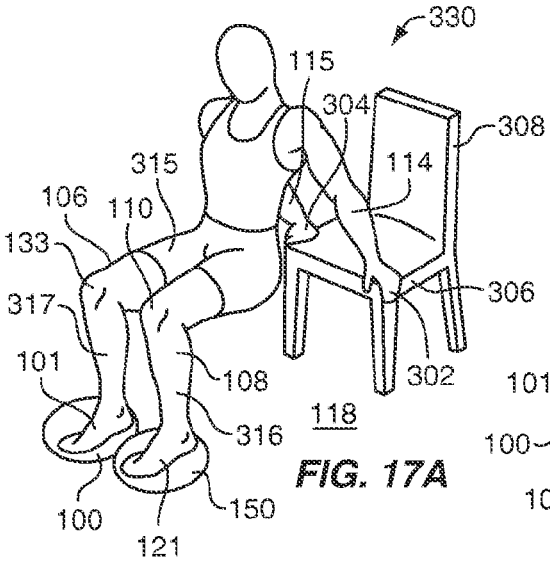
FIGS. 17A and 17B illustrate a triceps dip two-footed slide using a support exercise according to the invention.
Figure 17B:
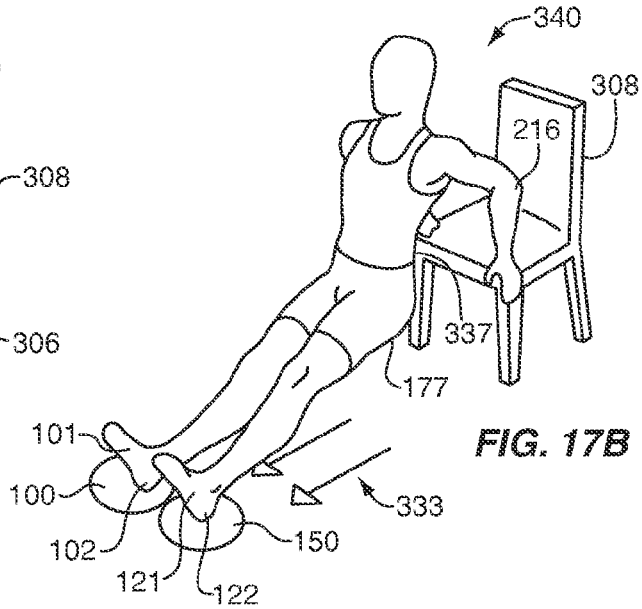

FIGS. 17A and 17B illustrate a triceps dip two-footed slide using a support exercise according to the invention. This exercise begins with the body turned with the back 337 to the support, the hands 302 and 302 grasping the front side portion 306 of the chair 308, the arms 114 and 115 straight, the feet 121 and 101 flat across the center of discs 150 and 100, respectively, the knees 110 and 133 bent so the lower legs 316 and 317 are perpendicular to the floor 118 and the upper legs 314 and 315 parallel to the floor as shown in position 330. The feet 101 and 121 are then pushed out in the direction of the arrows 333 with the legs 106 and 108 straightening, the feet 101 and 121 rotating naturally on the discs 100 and 150, respectively, so the heels 102 and 122 near the center of the discs. At the same time the elbows 216 and 217 are bent and the buttocks 177 lowered as in the position 340. The feet 101 and 121 are then pulled in and the arms 114 and 115 straightened to return to the position 330.

Figure 18A:
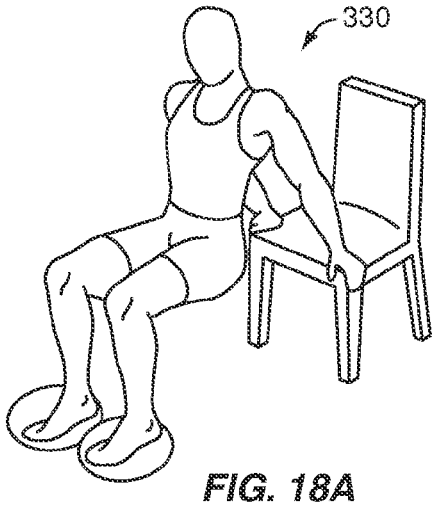
FIGS. 18A and 18B illustrate a triceps dip one-footed slide using a support exercise according to the invention.
Figure 18B:
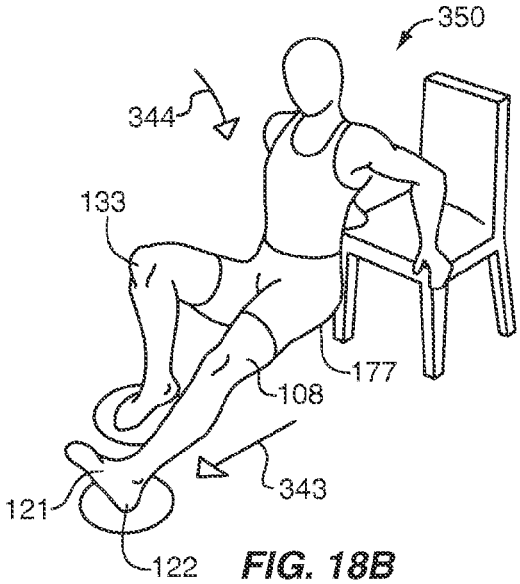

FIGS. 18A and 18B illustrate a triceps dip one-footed slide using a support exercise according to the invention. This exercise begins in the position 330 described above. In this case, only one leg 108 is straightened and one foot 121 is pushed out in the direction of arrow 343, while the opposite knee 133 is bent further as the buttocks 177 are lowered in the direction of arrow 344 into the position 350. The foot 101 121 is then pulled in and the arms 114 and 115 straightened to return to the position 330.

Figure 19A:
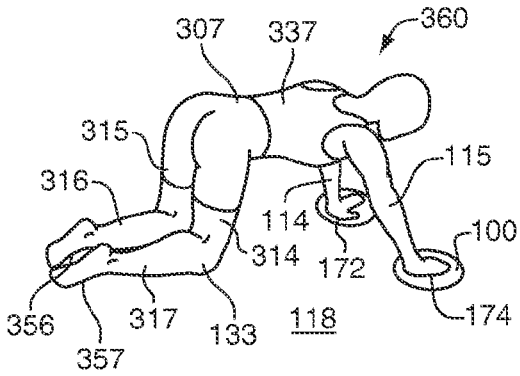
FIGS. 19A and 19B illustrate an ab roll exercise according to the invention.
Figure 19B:
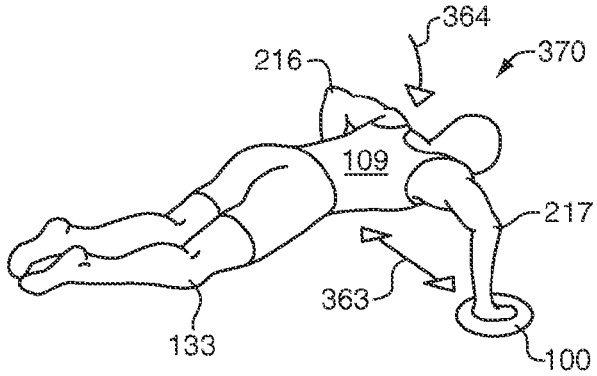

FIGS. 19A and 19B illustrate an ab roll exercise according to the invention. This exercise begins in a semi-kneeling position 360 with the lower legs 316 and 317 and the top portions 356 and 357 of the feet on the floor 118. The knees 110 and 133 are bent so the upper legs 314 and 315 make a small angle with the perpendicular to the floor 118. The body is bent at the waist 307 with the palms 172 and 174 on the center of the respective discs 150 and 100 and the arms 114 and 115 straight so the back is essentially parallel to the floor. The trunk 109 is then lowered by bending the elbows 216 and 217 and pushing the discs 150 and 100 apart in the directions of the double arrow 363. The knees 110 and 133 unbend in this process to reach the position 370. The discs 150 and 100 are then pulled together to return to the position 360.

Figure 20A:
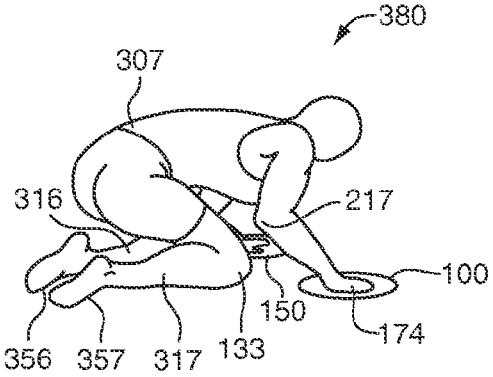
FIGS. 20A and 20B illustrate an ab slide exercise according to the invention.
Figure 20B:
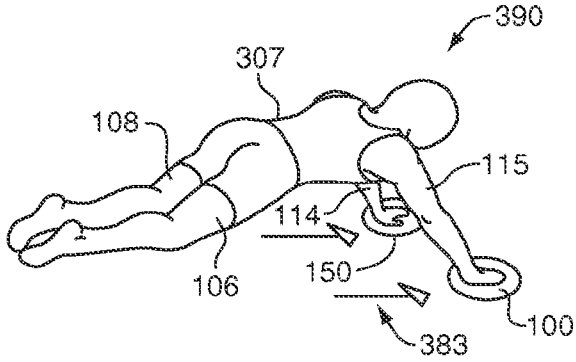

FIGS. 20A and 20B illustrate an ab slide exercise according to the invention. This exercise starts in the position 380 with the lower legs 316 and 317 and upper portions 356 and 357 of the feet against the floor as in position 360. However, here the knees 110 and 133 and the waist 307 are bent more and the elbows 216 and 217 are bent with the palms 172 and 174 again in the center of discs 150 and 100, respectively. The legs 106 and 108, waist 307, and the arms 114 and 115 are straightened with the discs 150 and 100 being pushed in the direction of the arrows 383 to reach the position 390. The knees, waist and elbows are then bent and the discs pulled back to return to the position 380.

Figure 21A:
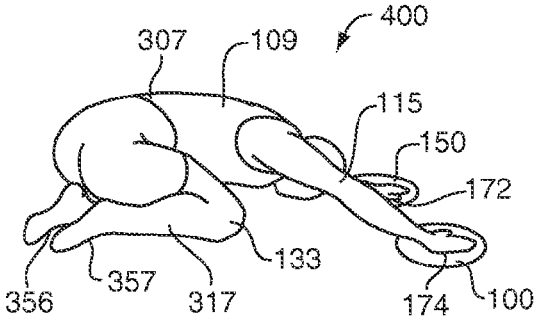
FIGS. 21A and 21B illustrate a shoulder stretch exercise according to the invention.
Figure 21B:
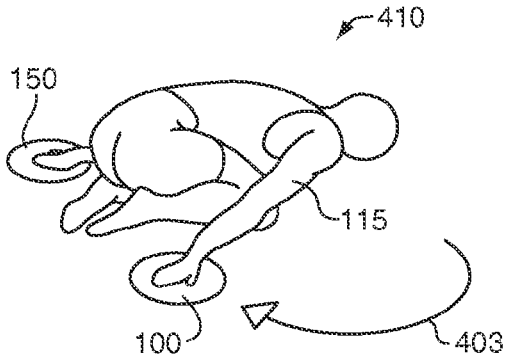

FIGS. 21A and 21B illustrate a shoulder stretch exercise according to the invention. This exercise begins in the position 400 with the lower legs 316 and 317 and the top portions 356 and 357 against the floor as in position 380. However, here the knees 110 and 133 and the waist 307 are bent further and the arms 114 and 115 straightened, with the palms 172 and 174 remaining flat on the discs 150 and 100 so the trunk 109 is lower. In this exercise, the arms 114 and 115 are swept backward as indicated by the arrow 403 to move the body and discs to the position 410. After a suitable stretch period, the arms 114 and 115 are swept forward in the reverse direction to arrow 403 to return to the position 400.

Figure 22A:
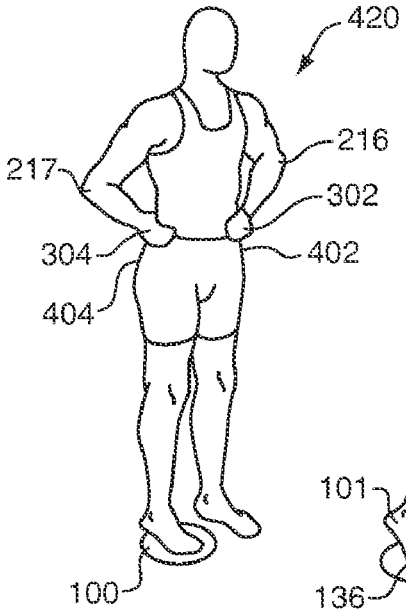
FIGS. 22A, 22B and 22C illustrate an adductor/abductor plie squat exercise according to the invention.
Figure 22B:
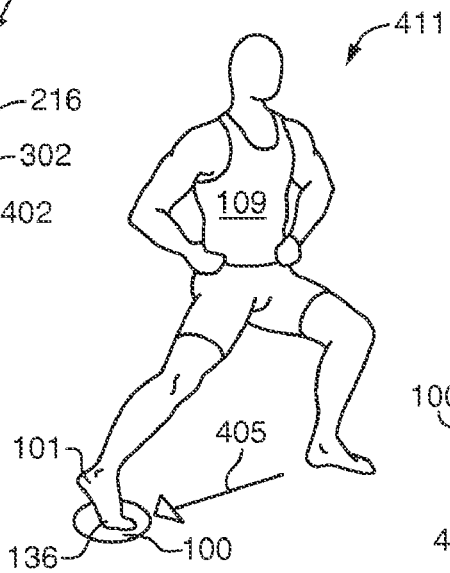
Figure 22C:
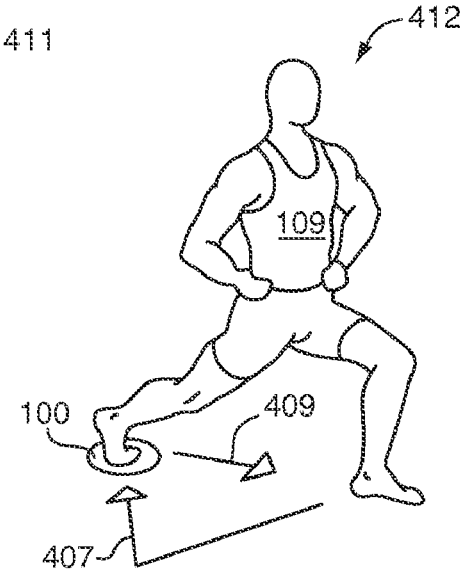

FIGS. 22A, 22B and 22C illustrate an adductor/abductor plie squat exercise according to the invention. This exercise is shown beginning in an alternative rest position 420 similar to the position 120 (FIG. 1A) except the hands 302 and 304 are on the hips 402 and 404, respectively, with the elbows 216 and 217 bent. The ball 136 of the foot 101 is then placed in the center of the disc 100 and the disc pushed outward in the direction of arrow 405 as the trunk lowered to the position 411. There may be pause here to stretch, and then the disc 100 is pushed backward along the direction of arrow 407 and the trunk 109 lowered further to the position 412. After a suitable stretch period, the body is then returned to the position 420 either by reversing the directions of arrows 407 and 405, or by pulling the disc forward along the direction of arrow 409.

Figure 23A:
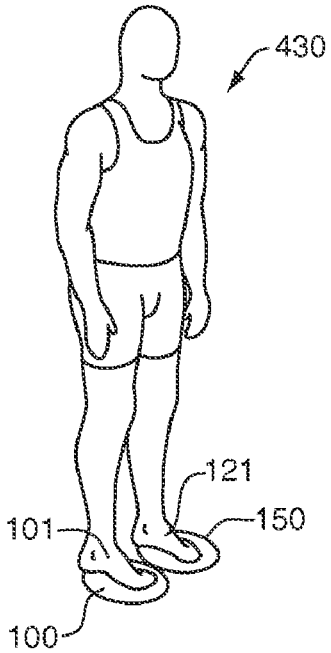
FIGS. 23A and 23B illustrate a lunge with slide exercise according to the invention.
Figure 23B:
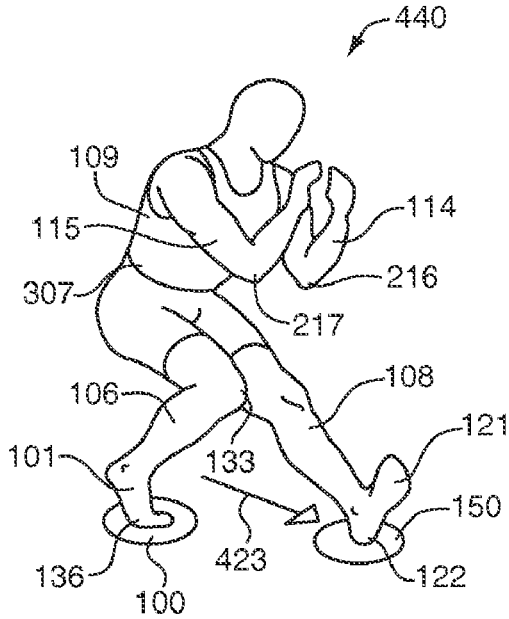

FIGS. 23A and 23B illustrate a lunge with slide exercise according to the invention. The exercise begins in the alternative two-disc rest position 430, which is the same as rest position 120 (FIG. 1A) except that each foot 101 and 121 are on a respective disc 100 and 150. The trunk 109 is then lowered by bending at waist 307 and one knee 133 while keeping the opposite leg 108 straight by pushing disc 150 out along the direction of arrow 423. The foot 101 rotates forward and moves slightly with respect to the disk 100 so that the ball 136 of the foot is in the center of disc 100, while the foot 121 rotates and moves slightly with respect to the disc 150 in the opposite direction so the heel 122 is in the center of disc 150. The arms 114 and 155 move forward and the elbows 216 and 217 bend to naturally balance the body to complete the position 440. The leg 106 is then straightened and the disc 150 pulled in to return to the position 430.

Figure 24A:
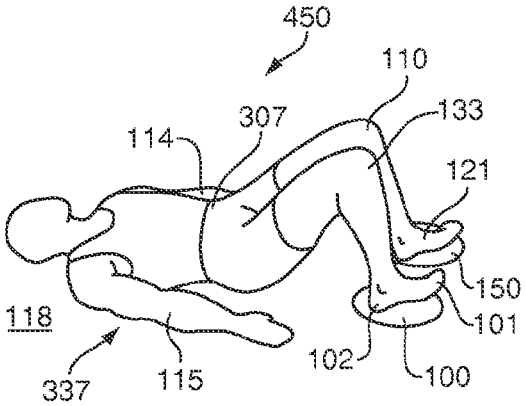
FIGS. 24A and 24B illustrate a supine stretch exercise according to the invention.
Figure 24B:
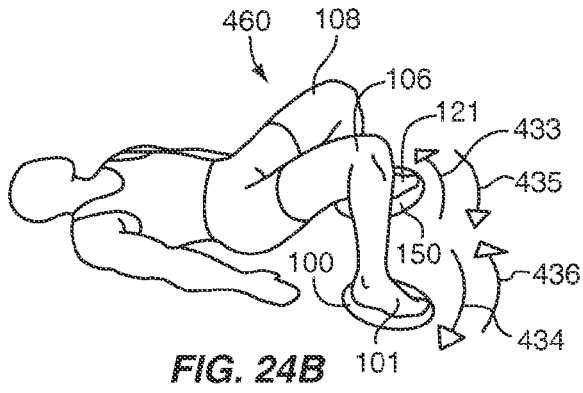

FIGS. 24A and 24B illustrate a supine stretch exercise according to the invention. The exercise begins in a supine knees bent position 450 with the back 337 and arms 114 and 115 resting on the floor 118 and the waist 307 and knees 110 and 133 bent, the feet 101 and 121 on the respective discs 100 and 150, with the weight a little back on the heels 102 and 122. The legs 106 and 108 are then spread with the discs 150 and 100 being moved in the directions of arrows 433 and 434, respectively, and then, after a suitable stretch period, returned along the direction of arrows 435 and 436 respectively, to return to the position 450. In the position 460, the weight naturally distributes more evenly along the feet 101 and 121.

Figure 25A:
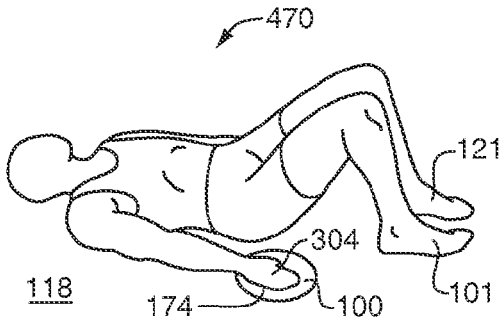
FIGS. 25A and 25B illustrate a sit-up exercise according to the invention.
Figure 25B:
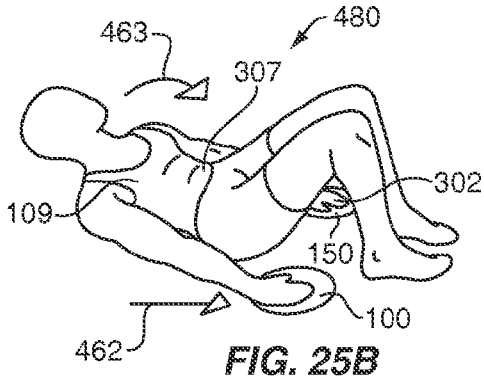

FIGS. 25A and 25B illustrate a sit-up exercise according to the invention. The exercise begins in the supine position 470 which is similar to the position 450 except the feet 101 and 121 are flat on the floor 118 and the hands 302 and 304 are palms 172 and 174 downward on discs 150 and 100, respectively. The trunk 109 is raised along the direction of arrow 463 by bending at the waist 307 while the hands push the discs 150 and 100 in the direction of the arrow 462 as shown at 480. The trunk 109 is then lowered to the position 470.

Figure 26A:
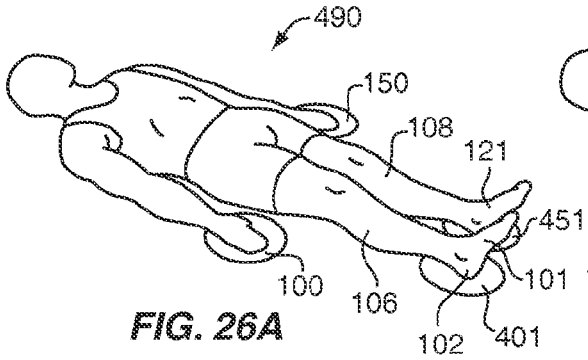
FIGS. 26A and 26B illustrate a four-disc stretch exercise according to the invention.
Figure 26B:
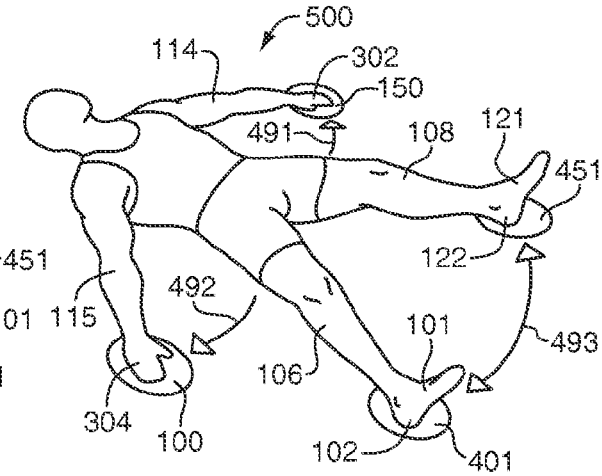

FIGS. 26A and 26B illustrate a four-disc stretch exercise according to the invention. This exercise starts in the position 490, which is the same as the position 470 except that the legs 106 and 108 are straight and the heels 102 and 104 are in the center of discs 401 and 451. The arms 114 and 115 are pushed outward along the directions of arrows 491 and 492 while the legs are pushed outward along the directions of arrows 493 to create the position 500. After a suitable stretch period, the arms and legs are returned to the position 490.

Figure 27A:
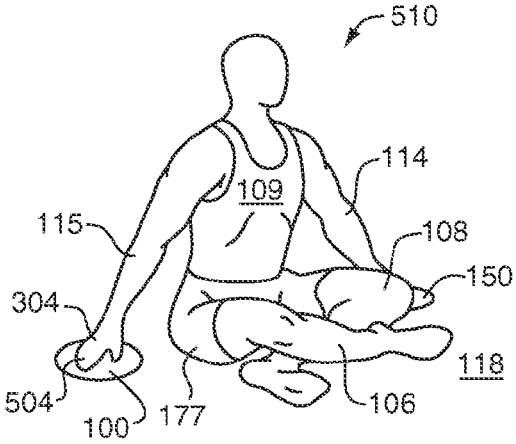
FIGS. 27A and 27B illustrate a side-bend exercise according to the invention.
Figure 27B:
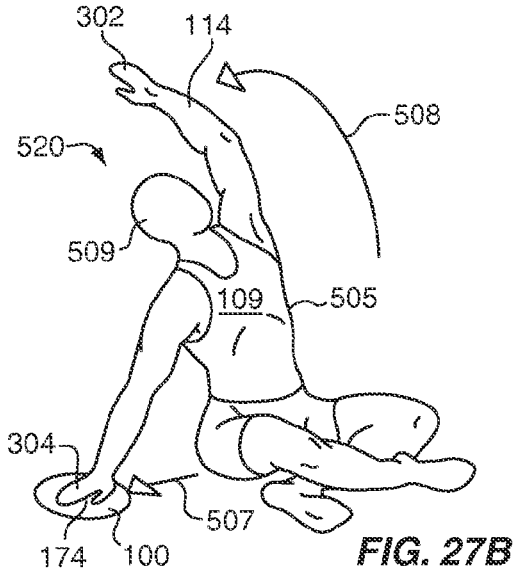

FIGS. 27A and 27B illustrate a side-bend exercise according to the invention. The exercise starts from a sitting position 510 with legs 106 and 108 crossed and trunk 109 upright, with the arms 114 and 115 extended at an angle from the trunk 109, one hand touching a disc 150 and the fingers 504 of the other hand 304 touching disc 100. Disc 150 could be removed with the other hand 302 touching the floor, but, as will be seen, two discs lend themselves to a series of exercises. Disc 100 is then pushed outward in the direction of arrow 507 while arm 114 is lifted up and over the head 509 along the direction of arrow 508 with the head bending 509 in the same direction to stretch the muscles of side 505 in position 520. After a suitable stretch period, the body is returned to position 510.

Figure 28A:
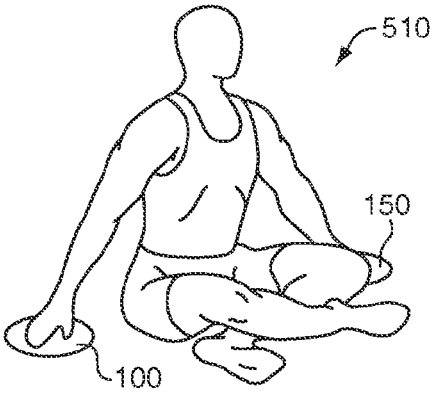
FIGS. 28A and 28B illustrate a trunk rotation exercise according to the invention.
Figure 28B:
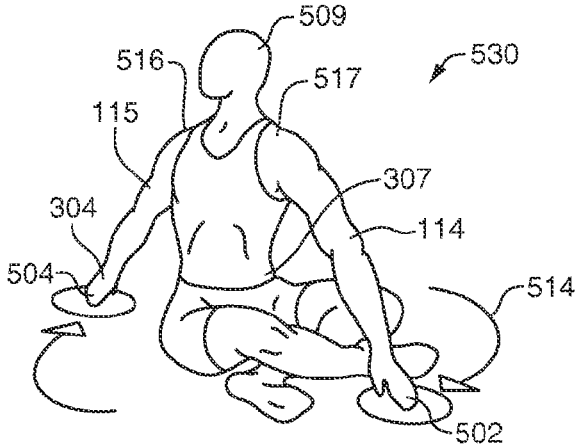

FIGS. 28A and 28B illustrate a trunk rotation exercise according to the invention. This exercise starts in position 510 with the fingers 504 of hand 304 touching disc 100 and the fingers 502 of hand 302 touching disc 150. The trunk is the rotated from the waist 307 to the shoulders 516 and 517 with the head also rotating and the arms 115 and 114 following the rotation and pushing the discs 100 and 150, respectively, in the direction of arrows 513 and 514, respectively. The body is then returned to the position 510 and/or turned in the opposite direction.

Figure 29A:
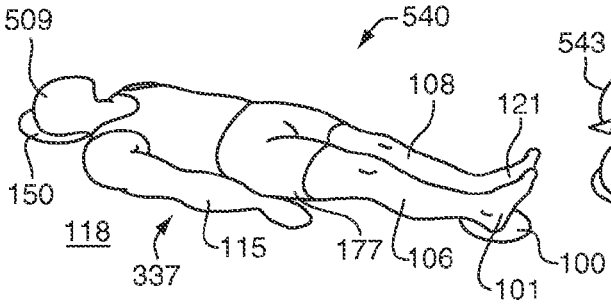
FIGS. 29A and 29B illustrate a neck stretch exercise according to the invention.
Figure 29B:
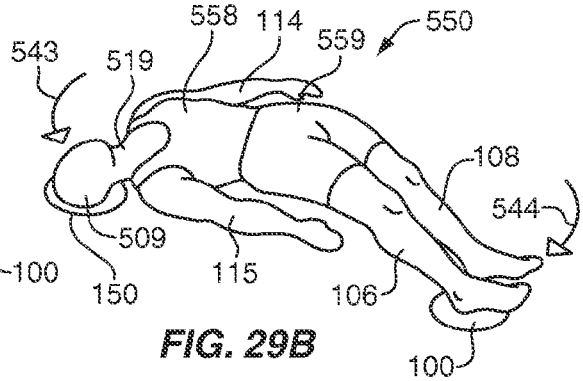

FIGS. 29A and 29B illustrate a neck stretch exercise according to the invention. This exercise starts from a supine position 540 with the feet 101 and 121 on disc 100 and the head 509 on disc 150. Alternately, the feet could be on separate discs. The entire rest of the body, including back 337, arms 114 and 115, buttocks 177 and legs 106 and 108 lie straight on the floor 118. The head 509, neck 519 and upper portion 558 of the body bend to push disc 150 in the direction of arrow 543, while the lower portion 559 of the body and legs 106 and 108 bend in the opposite direction to push disc 100 in the direction of arrow 544. After a suitable stretch period, the body then returns to position 540 and/or bends in the opposite direction.

Figure 30A:
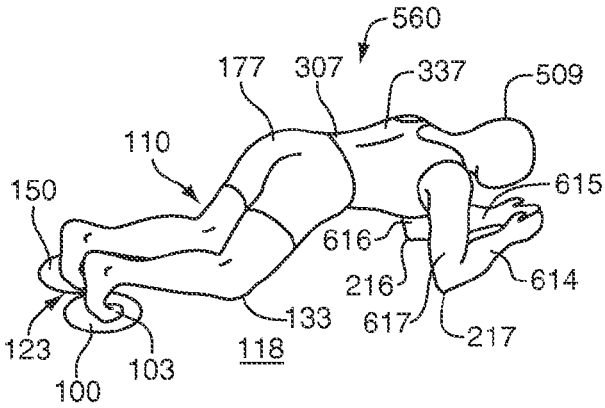
FIGS. 30A and 30B illustrate a prone leg stretch exercise according to the invention.
Figure 30B:
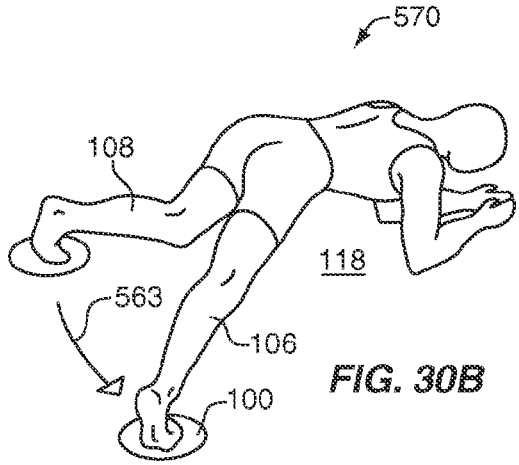

FIGS. 30A and 30B illustrate a prone leg stretch exercise according to the invention. The exercise starts in a position 560 with the toes 123 and 103 in the center of disks 150 and 100, respectively, the knees 110 and 133 resting on the floor 118 and bent, the upper body resting on the forearms 614 and 615 with the elbows 217 and 216 bent and the upper arms 617 and 616 essentially perpendicular to the floor 118, and the waist 307 bent so the buttocks 177 back 337 and head 509 are essentially parallel to the floor 118. The leg 106 is then straightened and spread to push disc 100 in the direction of arrow 563 to create the position 570. After a suitable stretch period, the leg 106 is then brought back in and the body returned to the position 560.

Figure 31A:
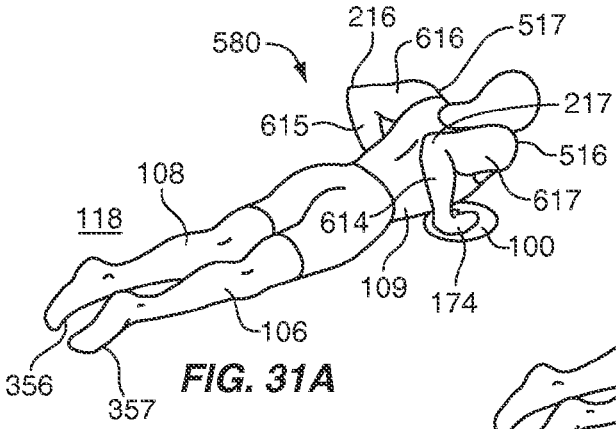
FIGS. 31A and 31B illustrate a push-up stretch exercise according to the invention.
Figure 31B:
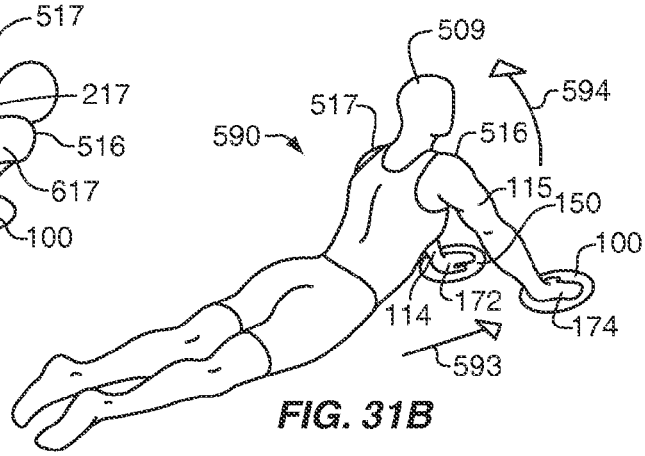

FIGS. 31A and 31B illustrate a push-up stretch exercise according to the invention. The exercise starts in a prone position 580 with the fronts 356 and 357 of the feet, the legs 106 and 108 and the trunk 109 against the floor 118, chest downward, the palms 172 and 174 flat on discs 150 and 100, respectively, the elbows 216 and 217 bent and shoulders 517 and 516 bent back so the forearms 615 and 614 are essentially perpendicular to the floor 118 and the upper arms 616 and 617 are essentially parallel to the floor. The arms 114 and 115 are straightened pushing the discs 150 and 100, respectively forward in the direction of arrow 593 while the head and shoulders 516 and 517 are raised in the direction of arrow 594 to reach the stretch position 590, which is held for a suitable stretch period, after which the body returns to the position 580.

Figure 32A:
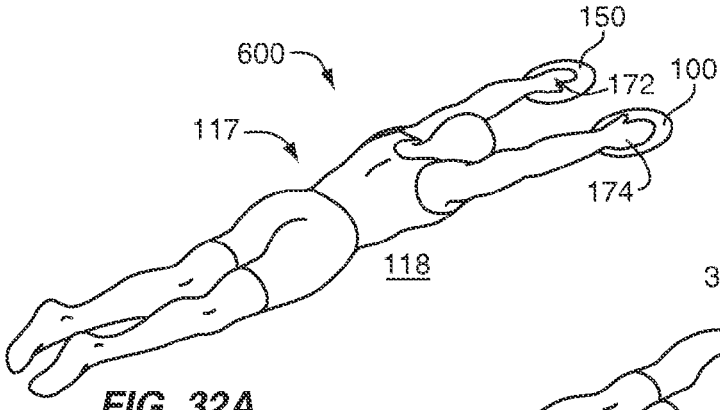
FIGS. 32A and 32B illustrate a pull-up stretch exercise according to the invention.
Figure 32B:
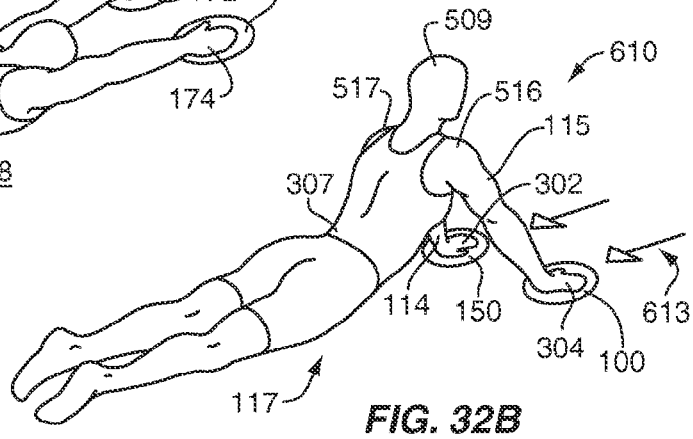

FIGS. 32A and 32B illustrate a pull-up stretch exercise according to the invention. The exercise starts from a completely prone position 600 with the entire body 117 lying face-down on the floor 118 with palms 172 and 174 flat in essentially the center of discs 150 and 100, respectively. The body 117 is then bent at the waist 307 raising shoulders 516 and 517 and head 509 while the hands 302 and 304 are drawn inward along the direction of arrows 613, keeping the arms 114 and 115 straight to arrive at the position 610. After a suitable stretch period, the body 117 is returned to the position 600.

Figure 33A:
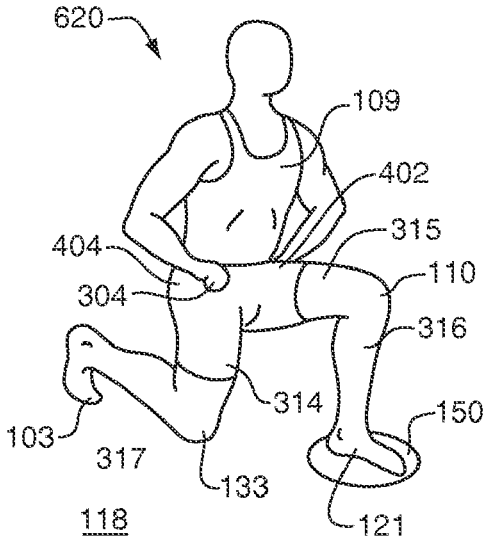
FIGS. 33A and 33B illustrate a squat-lunge exercise according to the invention.
Figure 33B:
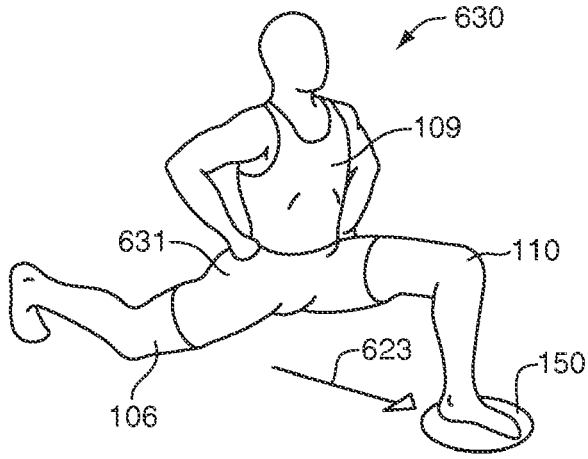

FIGS. 33A and 33B illustrate a squat-lunge exercise according to the invention. The exercise starts with the exerciser on one knee 133 with toe 103 on floor 118 and with the other foot 121 on disc 150. Knees 133 and 110 are bent so upper leg 314 and opposite lower leg 316 are essentially perpendicular to the floor and lower leg 317 and opposite upper leg 315 are essentially parallel to the floor. Hands 302 and 304 are preferably on hips 402 and 404, respectively, to complete the position 620. Leg 106 is straightened and hip joint 631 rotate back thrusting trunk 109 forward and at the same time knee 110 is unbent a small amount, the combination pushing disk 150 in the direction of arrow 623 to position 630. The position can be held for a stretch period, and then the body returned to position 620 to complete the exercise.

Figure 34A:
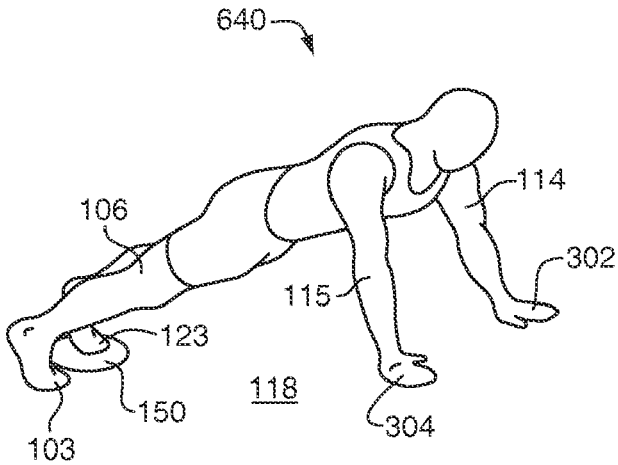
FIGS. 34A and 34B illustrate a leg cross-under exercise according to the invention.
Figure 34B:
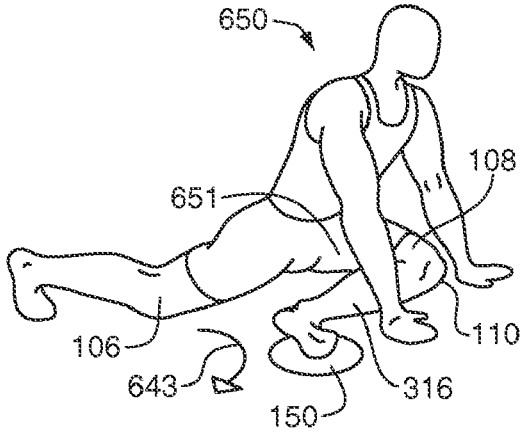

FIGS. 34A and 34B illustrate a leg cross-under exercise according to the invention. The exercise starts from a basic push-up position 640 with the toes 103 of one foot on the floor 118 and the toes 123 of the other foot on disc 150, hands 302 and 304 palm downward, and legs 106 and 108 and arms 114 and 115 straight. Leg 108 is then crossed under leg 106 pushing disc 150 in circular motion along the arrow 643, bending knee 110 and hip joint 651 to reach position 650. The position 650 may be held for a suitable period and then the body is returned to position 640.

Figure 35A:
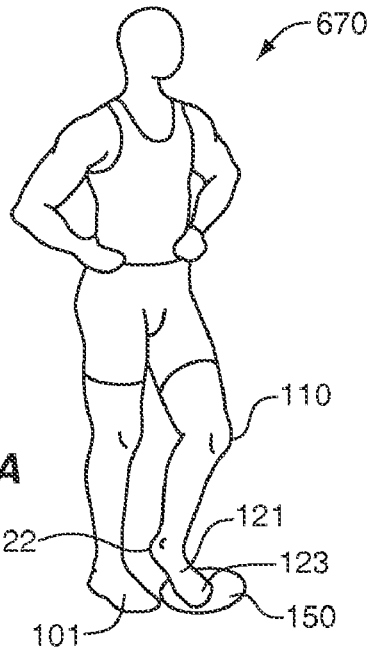
FIGS. 35A and 35B illustrate a stretch exercise according to the invention.
Figure 35B:
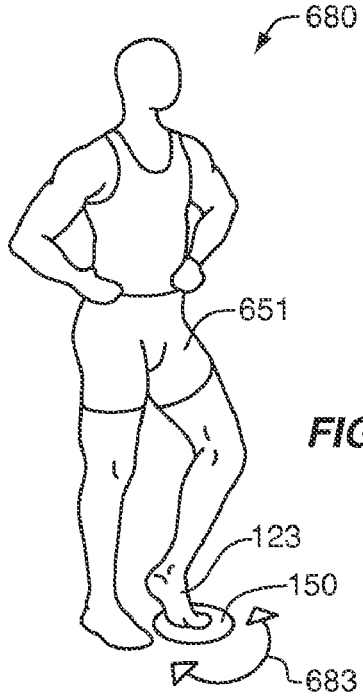

FIGS. 35A and 35B illustrate a hip rotator stretch exercise according to the invention. The exercise begins in position 670, which is similar to position 420 (FIG. 22A), except it is shown with the opposite foot 121 on disc 150 and the heel 122 already raised and the toe 123 moved to the center of the disc 150. The hip 651 is rotated to push disc 150 in a forward and back circular motion along the direction of arrow 683 as shown at 680, and then the body is returned to position 670.

Figure 36A:
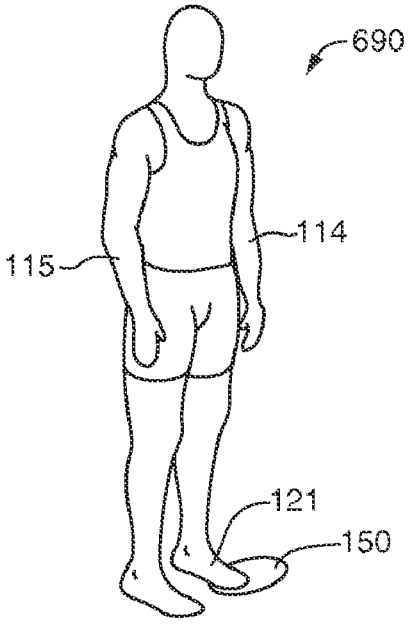
FIGS. 36A and 36B illustrate a lunge exercise according to the invention.
Figure 36B:
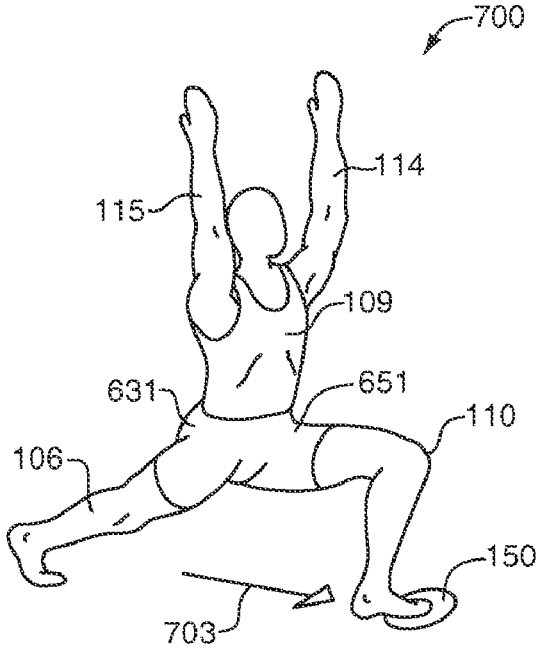

FIGS. 36A and 36B illustrate a lunge exercise according to the invention. The exercise starts in position 690, which is the same as position 120 (FIG. 2A), except that the disc 150 is under the opposite foot 121. The exerciser rotates thigh 631, pushing back on leg 106 and thrusting the trunk 109 forward, while, at the same time, bending knee 110 and rotating hip 651 to push disk forward along the direction of arrow 703. Arms 114 and 115 also may be lifted forward and up to end in pointed essentially straight upward to add to the lunge and assist in balance. There may be a suitable stretch period, and then the body returns to position 690.

The above exercises provide a sampling of the variety of exercises that may be performed with the sliding disk. Each of the exercises that are shown using one disk, such as the exercises of FIGS. 1A and 1B, 2A and 2B, 13A and 13B, 14A and 14B, 8A and 8B, 22A through 22C, 27A and 27B, 33A and 33B, 34A and 34B, 35A and 35B, and 36A and 36B, may be performed with the disk on the other side of the body using the opposite body parts, while those shown in only one direction, such as the exercises of FIGS. 3A and 3B, 11A and 11B, 12A and 12B, 18A and 18B, 30A and 30B, 23A and 23B, 28A and 28B, 29A and 29B, may also be performed in the opposite direction. While in some, a pause is mentioned, such as a stretch period, this pause of stretch period may be omitted, and in all a pause or stretch period may be added. A wide variety of other exercises may be designed. For example: exercises performed from a standing position can also include lunges in many directions such as to the side, back, or circling side to back, or include a slide in which the foot is lifted off the disk, the leg extended, and then the foot is placed back on the disk may be incorporated into many of the above exercises; exercises performed from a prone position can also be done holding onto a support such as a chair, step, platform, or floor, or the crossovers, such as 11A and 11B and 34A and 34B may be done with two discs, one under each foot; exercises performed from a supine position can include triceps dip slides, similar to FIGS. 17A and 17B, without the support, or any of the above supine exercises may be modified into a reverse road runner or hamstring extension; exercises performed from a sidelying position may be performed including a lift of the foot off the disc followed by a return of the foot to the disc; exercises performed in a seated or partially seated position can be performed with a support; and many other variations may be devised.

An exercise routine according to the invention may include a plurality of any of the above exercises or variations thereof. Individual exercises generally are repeated a number of times in a given routine. A routine may include a series of such exercises performed at a lower intensity for a limited time, for example one minute, followed by a more intense series of exercises for a longer period, such as five or ten minutes, which in turn may be followed by a cool down period of less intense exercises for another period, such as two minutes.

A sliding exercise workout incorporates the entire body using only the sliding discs. Beginners may need to feel comfortable with the sensation of sliding exercises. To do this an instructor can lead a class the following steps:

1. Identify proper posture and body alignment
2. Orient the participants to the proper position of foot/feet placement
3. Practice mounting and dismounting the discs
4. Practice small sliding motions holding on to a wall, a pole, a chair back, or trainer
5. Preferably, a workout should include a warm-up that rehearses the movements that will be performed in the workout.

A beginner may practice the sliding exercises according to the invention by using the sliding disc while holding on to a stable surface such as a chair, pole or door frame. This gives added control while the user gets comfortable with the disc and the sliding motion. It is also helpful to begin with exercises that use only one disc, so that the non-sliding leg is firmly planted on the ground. Exercises that involve two sliding discs (one sliding disc under each foot) may then be done after the user has mastered one disc exercises.

Preferably, instructors should teach progressively and allow students to advance at their own pace: first students should become familiar with sliding movement; then range of motion challenges can be added; increases in rotation, flexion or extension may then be added; additional weight challenges may then be added as well as increases or decrease movement speed.

Utilizing the above exercises, a person, such as an instructor, may choreograph exercises that are a balance between push and pull, flexion and extension, and rotation. A sample workout may include a seven to eight minute warm up, standing leg training for ten to twenty minutes, a variety of preferably multidirectional sliding lunges and squats, followed by seated flexibility exercises such as yoga and pilates for five to ten minutes, followed by exercises for strengthening core musculature for fifteen to twenty minutes in the prone, supine and side-lying positions, and finally a lying stretch series of exercises for five to ten minutes.

Sliding exercises according to the invention can also be inserted as segments into interval-style classes such as Step, Hi-Low, or Camp classes. Sliding disk type exercises are a great addition to the strength section of any exercises routine because they allow many different variations of basic body sculpting. For example, one may use a Step or Hi-Low routine for high cardio exercise and then come into a strength lower section with the disc exercises. As another example, for a step and sculpt class, one may use the step as your cardio and the discs for the sculpting.

Sliding exercises can not only be paired with existing workouts in an interval format, it can also be used to transform and enhance existing exercises. The sliding disc exercises are a powerful tool that can take a favorite workout to the next level of fun and effectiveness.

Yoga and Pilates, which are becoming increasingly popular in clubs and other programs will benefit greatly from the addition of sliding disc exercise routines, which allow for a deeper, longer range of motion and improved core stability. Bosu can be enhanced by using sliding exercises according to the invention to improve stability and balance.

The sliding exercises according to the invention can make a personal training session come alive by offering integrated muscle conditioning and compound movement that personal training clients have never experienced before.

III. The Sliding Element or Disc

Figure 37:
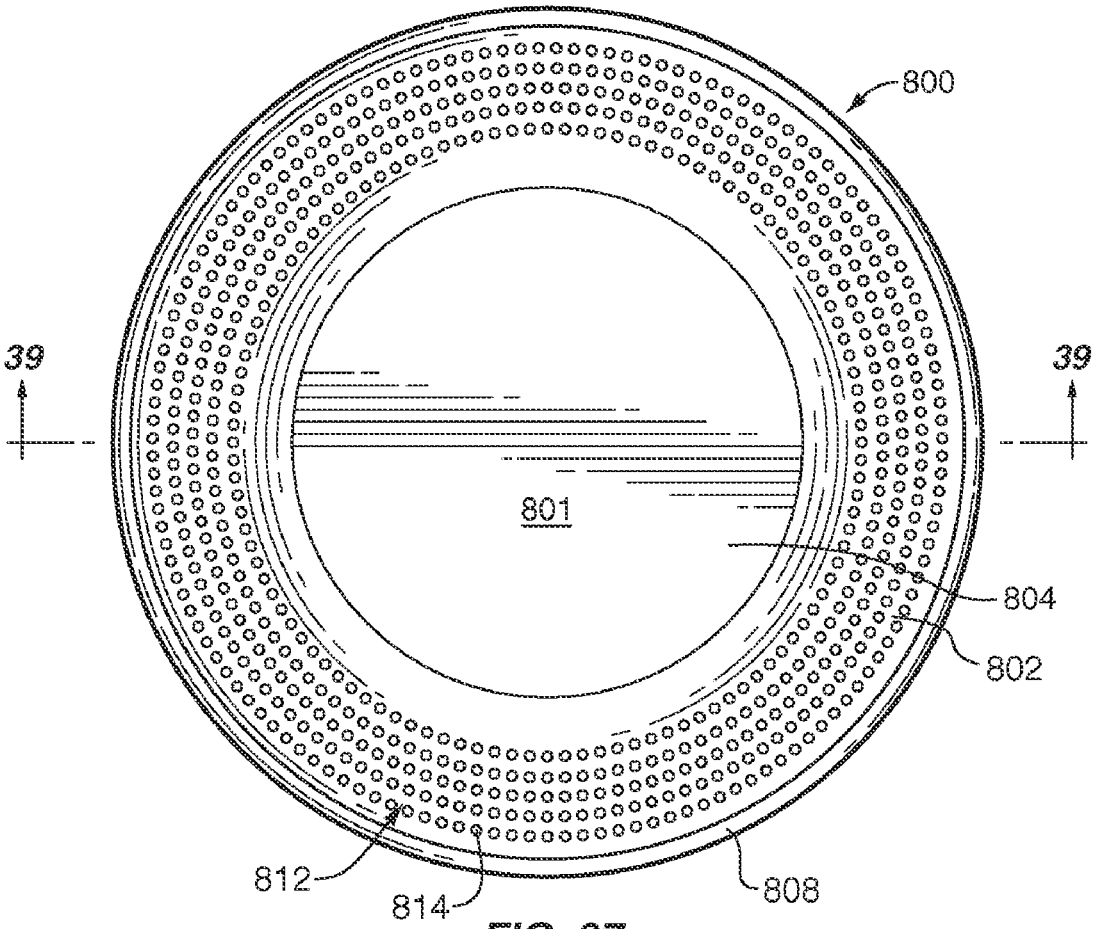
FIG. 37 is a top plan view of a preferred embodiment of a sliding disk according to the invention.
Figure 38:
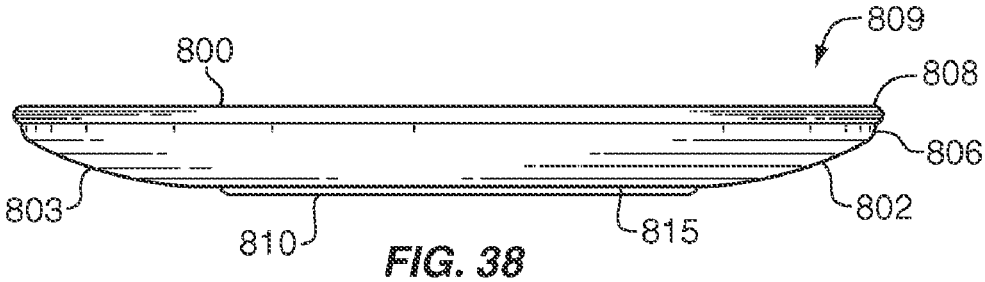
FIG. 38 is a side view of the disc of FIG. 37.
Figure 39:
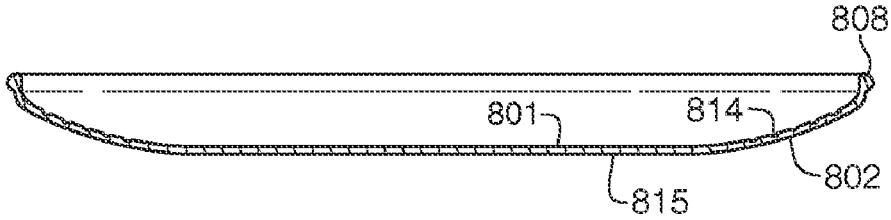
FIG. 39 is a cross-sectional view of the disc of 37 through the line 39-39 of FIG. 37.

Turning to FIGS. 37, 38 and 39, the preferred embodiment of a sliding element 800 according to the invention is shown. FIG. 37 shows a top plan view, FIG. 38 shows a side plan view, while FIG. 39 shows a cross-sectional view through line 39-39 of FIG. 37. The preferred sliding element 800 is a disc 800. Disc 800 includes a central body portion 804, preferably in the form of a circular plate, and circumferal member 802. Plate 804 has a lower sliding surface 815 and an upper surface 801. Circumferal member 802 extends away from the surface 801 at an acute angle, preferably in curve 803, such as an arc of a circle. Preferably, circumferal member 102 includes a flange 806, a gripping area 812, and a stop 108. Flange 806 extends in between curved portion 803 and stop 808. Gripping portion 812 is preferably a roughened portion of curved portion 803. In the preferred embodiment, the roughness is provided by small, round, indentations 814, but it also may be formed by grit embedded in the plastic of the disc, a self-stick mesh-like material, or any other suitable roughing. The indentations of the preferred embodiment happen to be in a decorative form of rows and columns of indentations, which has no functional advantage over other designs. Stop 108 is preferably in the form of a rounded lip and provides a stop 108 for the foot or hand. The surface 801 of central body portion 804 and the circumferal member 102 form a body portion 809 adapted for receiving a limb of a human body. The under surface 815 of the sliding element provides sliding surface adapted to slide on an exercise floor 118 (FIGS. 1A through 36B and 46-48). In this disclosure, "exercise floor" includes a floor, a mat, a raised platform, or any other floor-like surface on which an exercise may be performed. It also includes any type of floor surface. Surface 801 may be beveled outward slightly in a downward direction as one goes from curved portion 803 to the middle of the surface 801 to produce a slight bulge (not shown) which tends to flatten when weight is put on the disc. This distributes the weight on the disc more evenly, allowing the disc to slide more smoothly, particularly on surfaces that may not be entirely smooth. Optionally, the disc may also include a friction adjustment/protective layer 810. This friction adjustment/protective layer 810 allows the friction of the surface 815 to be adjusted to various floor 118 surfaces. For example, if the exercise surface is a hardwood floor, layer 810 may be a soft cloth material that slides more easily on hardwood and will not scratch the hardwood, and thus protects the floor. Layer 810 is preferably attached to disk 800 with a self-stick backing. In the preferred embodiment, disk 800 is molded of nylon, though any other plastic or other suitable material may be used, no adjustment/protective layer 810 is provided, and the disk 800 is intended for use on carpets or other suitable material.

Figure 40:
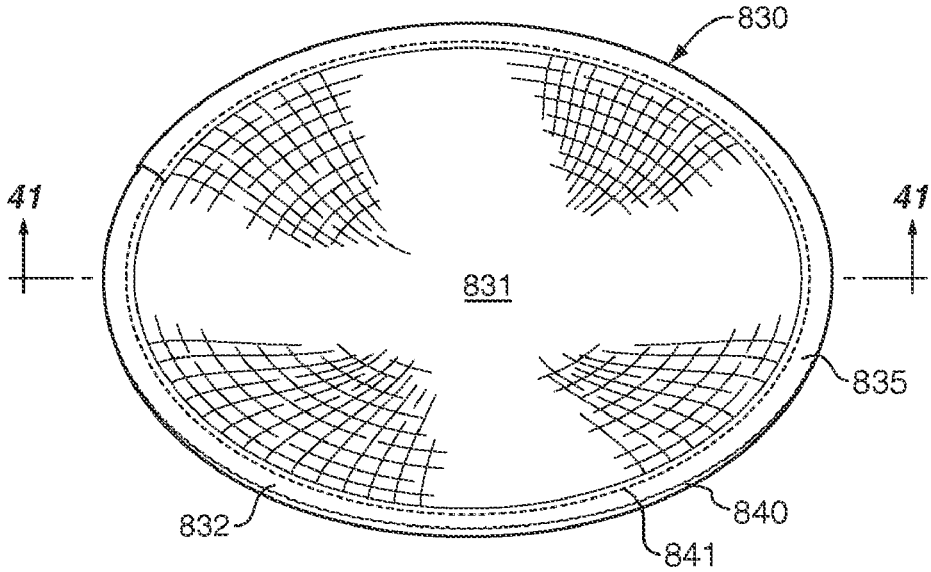
FIG. 40 is a perspective view of an alternative preferred embodiment of a sliding disk according to the invention.
Figure 41:
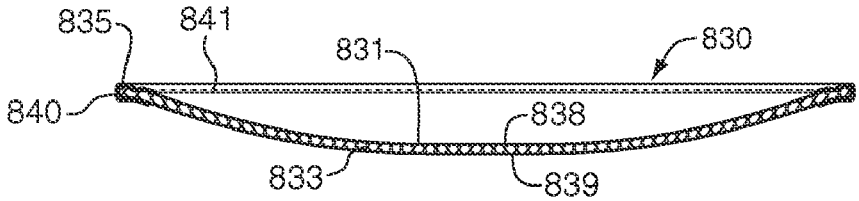
FIG. 41 is a cross-sectional view of the disc of FIG. 40 taken through the line 41-41 of FIG. 40.

FIGS. 40 and 41 show another preferred embodiment of the sliding element 830 according to the invention that preferably is designed for use on hard surfaces, such as hardwood floors or linoleum. FIG. 40 shows a perspective view of the sliding element 830 and FIG. 41 shows a cross-sectional view through the line 41-41 of FIG. 40. Element 830 comprises an outer cover 831 and a more rigid core 833. Core element 833 preferably has a curved inner portion and a circumferal stopping element 835, which is preferably in the form of a lip 835. Cover 831 fits tightly on core 333 and provides a durable outer surface. Outer cover 831 preferably includes an upper cover 838, a lower cover 839, and a circumferal portion 840 which folds over lip 835 and overlaps the upper cover 838 and lower cover and lower cover 839. Stitching 841 preferably secures the upper cover 838 and lower cover 839 to circumferal portion 840 and all three cloth parts 838, 839, and 840 to core 833, although glue or other securing material or process may be used. Preferably, there are several rows of stitching 841. The cover 831 is preferably made of cloth, and more preferably nylon, though polyester or other cloth may also be used. Core 833 is preferably made of polymer, more preferably a foam plastic, such as foamed polyethylene, and most preferably is an ethylene-vinyl-acetate/polyethylene (EVA/PE) blend. Preferably, the PE is a low density polyethylene (LDPE).

Figure 42:
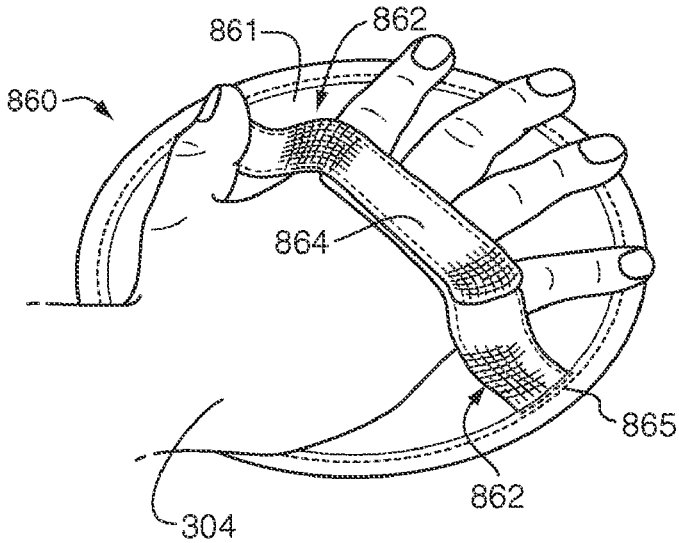
FIG. 42 illustrates another alternative embodiment of a sliding element according to the invention with a person's hand inserted in it.

FIG. 42 shows another embodiment of a sliding element 860 according to the invention. This embodiment is the same as the embodiment of FIGS. 41 and 42, except that it includes a body member 861 and fastener 862 for securing the sliding element body member 861 to the hand or foot of a user. Fastener 862 preferably comprises an adjustable strap 864 and a connector 865 for connecting the strap 864 to the body member 861. The strap 864 allows for either a hand 302 or 304 or foot 101 or 121 to be fastened to the body member 861 for better gripping of the disc. Fastener 862 is preferably made of cloth, such as nylon or a nylon blend, and connector 865 is preferably thread, such as nylon or nylon blend thread, though other connector material may be used. A fastener, such as 862, could be used in essentially all of the designs discussed above, but is an optional feature of the invention.

Figure 43:
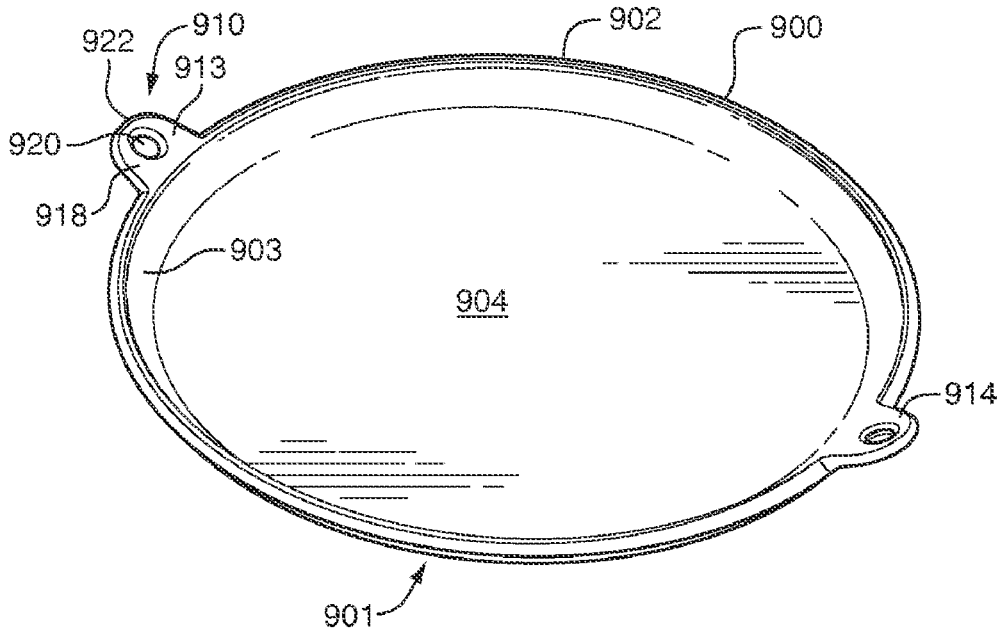
FIG. 43 illustrates a top perspective view of a further alternative embodiment of a sliding disc according to the invention.
Figure 44:
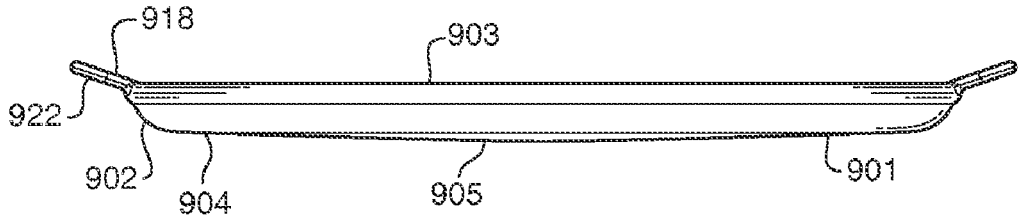
FIG. 44 is a side view of the sliding disc of FIG. 43.

FIGS. 43 and 44 show another alternative embodiment of a sliding member 900 according to the invention. Sliding member 900 includes a body member 904 and a stop, 903, preferably in the form of a lip 903. Body member 904 includes a plate-like portion 901 and an upward curved portion 902. Plate-like portion 901 is beveled downward to produce a slight bulge 905 which tends to flatten when weight is put on the disc Alternative embodiment 900 also includes an attachment element 910, which in the embodiment shown comprises and ear 913 comprising a member 918 extending from lip 902 and having an eyelet 920. The distal end 922 of member 918 is rounded. Preferably, there are two ears 913 and 914.

Figure 45:
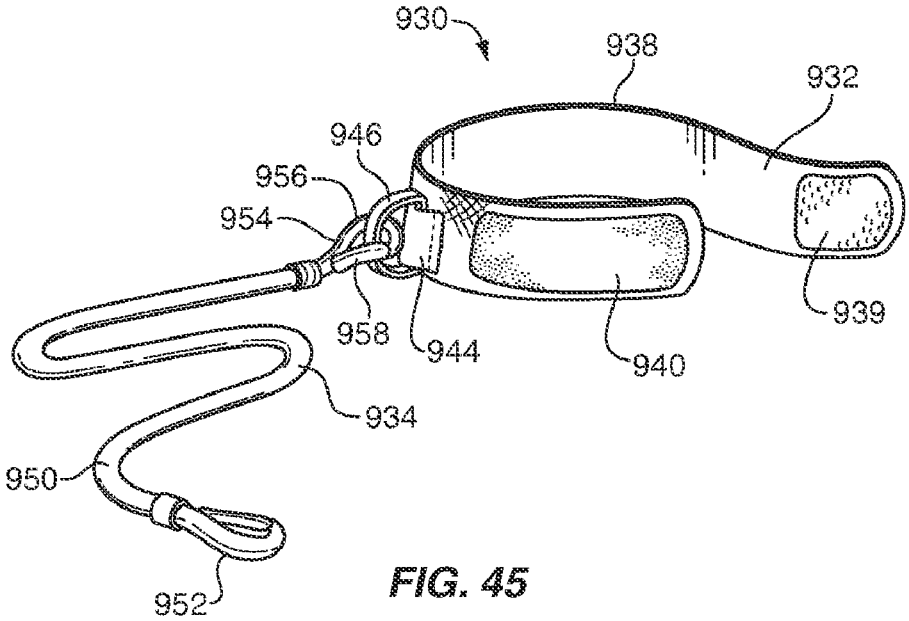
FIG. 45 shows a resistance element that may be used with the sliding element of FIG. 43.

FIGS. 45 shows a disc attachment device 930 which permits two sliding elements 900 to be attached to each other or permits a sliding element 900 to be attached to a body portion, such as an ankle. Attachment device 930 includes a body portion attachment element 932 and a resistance element 934. Preferably body portion attachment element 932 comprises a strap 938, a ring connector 946, and hook and loop connecting members 939 and 940. Resistance element 934 preferably includes an elastic band 350 having clip connectors 952 and 954 attached to either end. Clip connectors each preferably include a hook portion 956 and a movable spring portion 958 for closing the opening in the hook. To attach a disc to a body portion, strap 938 is attached to the body portion, one clip, such as 954, is connected to ring 946, and the other clip, such as 952 is connected to eyelet 920 in ear member 913. Two discs 900 may be connected by connecting one clip 952 to the eyelet in one disc and the other clip 9544 to the eyelet in the other disc 900.

Figure 46:
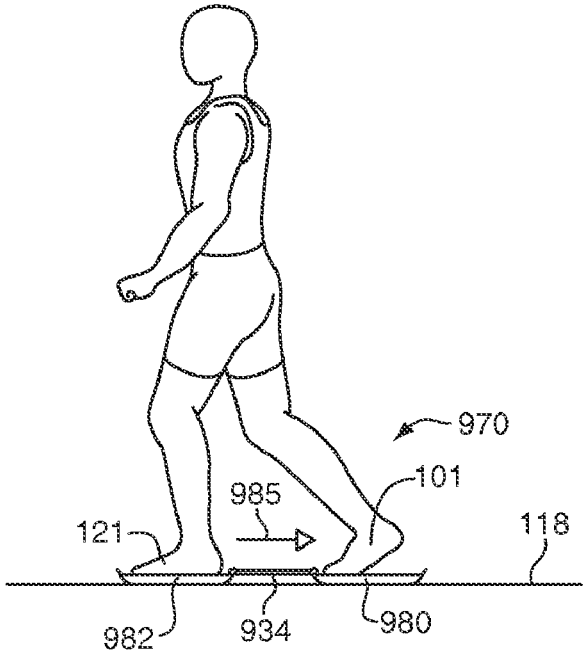
FIG. 46 illustrates a lunge exercise performed with two sliding elements as in FIG. 43 attached with the resistance element of FIG. 45.
Figure 47:
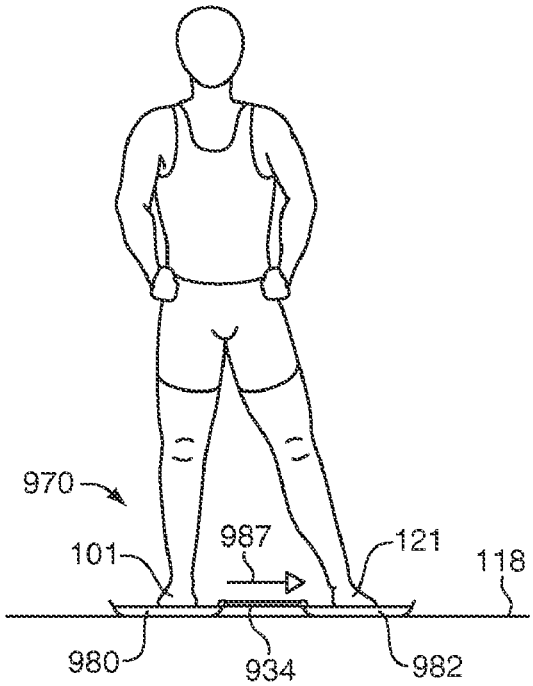
FIG. 47 illustrates a squat exercise performed with two sliding elements as in FIG. 43 attached with the resistance element of FIG. 45.
Figure 48:
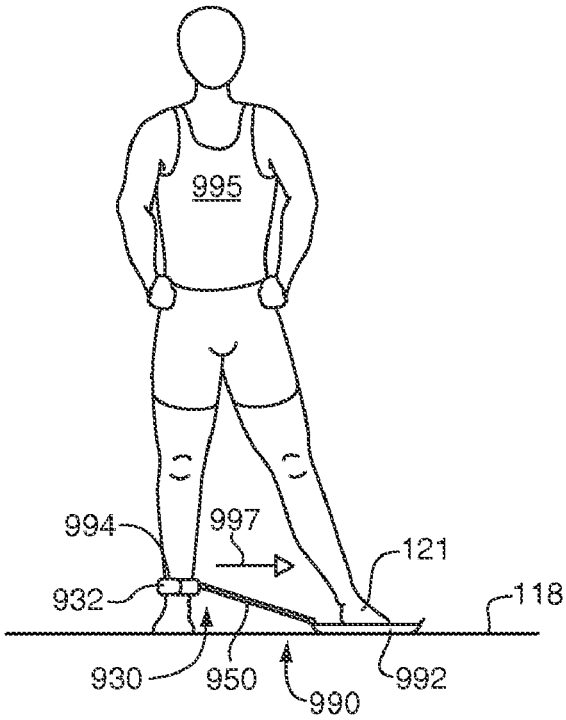
FIG. 48 illustrates a squat exercise performed with a sliding element as in FIG. 43 attached to an ankle of the exerciser with the resistance element of FIG. 45.

The embodiment 900 with attachment member 910 allows for the exercises to be accomplished with the "assistance" of resistance, in that the resistance helps to pull the user back, and also works the user hard as the leg or other body portion is pushed outward. The exercises are essentially the same in using the resistance, except that the resistance can be used (depending upon the exercise) to either increase the difficulty of the exercise or decrease the difficulty. FIG. 46 shows a lunge being performed using resistance exercise system 970 comprising a first disc 980 and a second disc 982 connected with resistance element 934. A first foot 101 is placed on first disc 982 while a second foot 121 is placed on second disc 982. The second foot is pushed in the direction shown by the arrow 985 in a lunge movement, with disc 980 sliding on exercise surface 118, which is preferably a floor. FIG. 47 shows a sideways lunge movement performed with resistance exercise system 970 including a first disc 980, a second disc 982 and a resistance element 934. In this case, the second foot 121 is slid sideways in the direction of the arrow 987 in a sideways lunge movement. FIG. 48 shows the same sideways lunge exercise being performed with a resistance system 990 including a single disc 992 and an attachment device 930. In this case attachment member 932 is attached to an ankle 994 of the user 995 and the disc 992 is again pushed in the direction of arrow 997 in the lunge movement.

A feature of the invention is that the sliding elements 800, 830, 860, and 900 according to the invention provide 1) durability of the sliding element, 2) the correct friction coefficient on the bottom surface of the plate and 3) a friction coefficient that stays constant, thereby giving a consistency in the sliding surface. With respect to the friction coefficient, the bottom surface 815 of the disc preferably has an appropriate glossiness for the skill level of the user. For example, a beginning user would not want an extremely slippery sliding element, as then it is more difficult for the user to maintain balance during the exercises. That is, for a beginner, the sliding surface 815, 810, 901 etc. of the disc can't be like a slippery banana. At the same time, surface 815, 810, 901 etc. should be relatively smooth so that it will slide over a variety of floor surfaces without "sticking" to the floor. However, more advanced users will desire a more slippery sliding element. In other words, there is a correct friction coefficient that provides the particular user with smooth, even sliding yet is not so slick that the user looses her or his balance. Thus, the invention contemplates that the sliding element according to the invention will be sold in a plurality of grades having different coefficients of friction. A further feature of the invention is that the sliding elements 800, 830, 860, and 900 are designed to slide across a variety of floor surfaces, such as carpet, linoleum, hard wood floors, etc. It has been found that nylon gives good all-around results.

The size of the disc can vary with the preferred diameter in the range of 8 inches to 12 inches, and more preferably about 9.25 inches in diameter. The bulge 905 in the embodiment of FIGS. 4 is approximately 0.63 inches. Generally, the size is such to accommodate the ball of the user's foot, for the upright exercises, and the user's hand for the prone position exercises. The function of the upturned portion, such as 803, is to provide a stop to the foot and to keep the edge of the disc from catching on floor surface (i.e. digging into the carpet) as it slides. This can alternatively be accomplished by a convex shape without a lip, or a rounded edge. The preferred embodiment is a circular disc, although other shapes, such as oval, octagonal, etc. also work.

Regarding construction materials, a variety of plastics and moldable or shapeable materials will work, i.e. poly-ethylene, poly-propylene, nylon, wood or wood based composite materials, or stiff cloth. The preferred materials have flexibility to them such that an upturned edge 903 and lip 808 can bend slightly if stepped on; that is it should not be a brittle material that would break under pressure. Depending upon the friction coefficient of the base material, then the bottom surface of the disc may be adjusted, to provide for the ideal friction coefficient of the disc for the given material. For example, nylon with a gloss surface has a different friction coefficient than poly-ethylene with a gloss surface, and thus the finish may be different for these different materials to provide for the ideal friction coefficient of the disc. An alternate construction can also include two-ply construction methods. For example, to protect against possible scratching on hardwood surfaces, a felt cover 810 can be adhered to the bottom surface 815 of the disc.

Regarding the exercises, the discs can be used to perform both strength training exercises as well as aerobic exercises as demonstrated in the discussion above. The exercises work multiple muscles at once, which adds to the efficiency of the exercises. Essentially all muscles of the body can be trained using the discs: lower body, upper body, as well as abdominal and back. The exercises utilize the person's body weight to work the muscles. For example, a lunge requires the user to pull his or her body weight back up from the lunge position. Additionally, the sliding motion requires the user to stabilize and balance throughout the exercise movement. Exercises that require stabilization have been found to require more effort from a wider variety of muscles, thus, they are more effective as well as require recruitment of additional stabilization muscles (i.e. core abdominal muscles to hold the body in alignment for balance). Results of initial studied indicate that the sliding exercises according to the invention result in a more wholesome body appearance, which is thought to be due to the fact that more of the muscle groups are used in the exercise, so that there is no exaggerated development of one or a few muscles. The sliding movements also comprise extension elements that usually include stretching. The disc facilitates a controlled, extension and stretch that preliminary data suggests reduces injuries often associated with stretching exercises, such as spasms and tearing. The exercises can also be sequenced in a manner to 1) emphasize training of a particular body part (i.e. buns and thighs), or 2) to provide a total body training.

Another feature of the invention is the aspect of graceful movement that is added to exercises. The sliding disc transforms sometimes awkward exercise movements into smooth, graceful lines of flowing motion. Ending positions that were previously guessed at slide into place. For example, a lunge that was once static becomes a fluid path from start to finish. The entire movement becomes engaging and purposeful. The sliding disk can enhances any exercise routine to make it come alive and old exercises are reborn. The sliding disk takes choreography to a new level, allows for a greater range of motion, strengthens and lengthens muscles at the same time, can be used in a stand alone format, or as segments of interval style classes, can be incorporated into a personal training session, assists in training proper movement patterns, and incorporates body sculpting, balance, flexibility, core and cardio into a seamless exercise system.

IV. Applications of the Invention

It is evident from the above that the inventive sliding element is itself a useful application of the invention and the invention contemplates that the sliding elements will be sold in a variety of models. In addition, it is evident that the exercise routines of the invention are also useful in themselves, and aerobic and exercise sessions, routines, seminars and courses including the exercise routines can be marketed and sold, either by charging for an individual session, a group of sessions, licensed to health clubs and sold via membership fees, or sold in any other manner that exercise routines are sold. This includes teaching the routine to other instructors in continuing education classes, putting the routines on the internet, which could drive sales of other products on the internet site, or people could be charged a fee for access to the site. Clearly, the routines according to the invention can be sold as printed material, i.e. booklet or instructional book. In addition, a prototype demonstration exercises video tape has been made, though not yet sold. Thus, the invention contemplates that a video tape, DVD, or a recorded image of the exercise routines according to the invention in any other recordable medium will be sold. In addition, the invention contemplates a kit including one or more sliding elements of one or more of the types and classes discussed above, a recorded image of routines according to the invention on video tape, DVD, or other medium, and/or instructions or descriptions of the exercises in a printable medium, such as a booklet or instructional book.

A feature of the invention is that the sliding exercises utilize little equipment, and can easily be performed almost anywhere, such as the home or office, which increases the chances that the exercises will be performed. And unlike other exercise equipment, there is no storage issue. The sliding discs are lightweight, compact, and come in versions specially designed for both hard wood and carpeted floors.

The particular systems, designs, methods and exercises described herein are intended to illustrate the functionality and versatility of the invention, but the invention should not be construed to be limited to those particular embodiments. Devices, systems and methods in accordance with the invention are useful in a wide variety of exercise routines. It is evident that those skilled in the art may now make numerous uses and modifications of the specific embodiments described, also evident that the routines and movements recited may, in some instances, be performed in a different order; or equivalent structures and processes may be substituted for the structures and processes described. Since certain changes may be made in the above systems and methods without departing from the scope of the invention, it is intended that all subject matter contained in the above description or shown in the accompanying drawing be interpreted as illustrative and not in a limiting sense. Consequently, the invention is to be construed as embracing each and every novel feature and novel combination of features present in or inherently possessed by the systems, methods and routines described in the claims below and by their equivalents.

The invention claimed is:

1. A method of exercising a human, said method comprising:

providing a sliding element having a body portion and a circumferential portion, said body portion having an upper surface adapted for receiving a limb of said human and a lower sliding surface adapted to slide on a exercise floor and having a center point, said circumferential portion tapered upward away from said sliding surface about the entire periphery of said sliding surface thereby permitting said sliding surface to slide smoothly on said exercise floor in any direction, the lower surface extending from the center point to the circumferential portion being smooth placing said sliding element on an exercise floor;

while said human is standing, placing a foot of said human on said upper surface of said body portion and weighting said foot; and without the use of a handle or strap and without restraining said sliding element except by said exercise floor and said foot, performing an exercise program including sliding said sliding element by moving said foot.

2. A method as in claim 1 wherein said exercise program comprises two or more routines selected from the group consisting of: routines performed with said human body in a standing position; routines performed with said human body in a prone position; routines performed with said human body in a supine position; routines performed with said human body in a side-lying position; and routines performed in a seated or partially seated position.

3. A method as in claim 2 wherein said exercise program comprises three or more routines selected from said group.

4. A method as in claim 1 wherein said performing comprises a strength development exercise routine to enhance muscle strength development and a stretching exercise routine to enhance muscle flexibility and length.

5. A method as in claim 1 wherein said method further comprises removing said foot from said sliding element, placing a hand of said human on said sliding element, weighting said hand, and, without the use of a handle or strap, performing an exercise program including sliding said sliding element by moving said human hand.

6. A method as in claim 1 wherein said sliding element comprises a sliding disc.

7. A method as in claim 1 wherein said upper surface includes a textured portion to permit said sliding element to be gripped substantially without slipping by said human limb, and said placing comprises placing said foot in contact with said textured portion.

* * * * *